US008157873B2

(12) United States Patent
Murphy et al.

(10) Patent No.: US 8,157,873 B2
(45) **Date of Patent: *Apr. 17, 2012**

(54) WAX AND WAX-BASED PRODUCTS

(75) Inventors: Timothy A. Murphy, Yorkville, IL (US); Michael D. Shepherd, Rock Hill, SC (US)

(73) Assignee: Elevance Renewable Sciences, Inc., Bolingbrook, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/903,570

(22) Filed: Oct. 13, 2010

(65) Prior Publication Data

US 2011/0165529 A1 Jul. 7, 2011

Related U.S. Application Data

(62) Division of application No. 11/502,977, filed on Aug. 11, 2006, now Pat. No. 7,833,294, which is a division of application No. 10/434,447, filed on May 8, 2003, now Pat. No. 7,192,457.

(51) Int. Cl.
*C10L 5/00* (2006.01)
*C11C 5/00* (2006.01)

(52) U.S. Cl. ..... 44/275; 431/288

(58) Field of Classification Search ..... 44/275; 431/288

See application file for complete search history.

(56) References Cited

U.S. PATENT DOCUMENTS

| | | | |
|---|---|---|---|
| 1,935,946 | A | 11/1933 | Egan et al. |
| 1,954,659 | A | 4/1934 | Will |
| 2,468,799 | A | 5/1949 | Ziels et al. |
| 2,784,891 | A | 3/1957 | Thielke |
| 3,448,178 | A | 6/1969 | Flanagan |
| 3,630,697 | A | 12/1971 | Duling et al. |
| 3,645,705 | A | 2/1972 | Miller et al. |
| 3,744,956 | A | 7/1973 | Hess |
| 3,844,706 | A | 10/1974 | Tsaras |
| 4,118,203 | A | 10/1978 | Beardmore et al. |

(Continued)

FOREIGN PATENT DOCUMENTS

| | | |
|---|---|---|
| DE | 19956226 | 5/2001 |

(Continued)

OTHER PUBLICATIONS

Behren et al., "Beeswax and other Non-Paraffin Waxes," Presented at NCA Technical Meeting, Jun. 19-20, 1991, 6 pages.

(Continued)

*Primary Examiner* — Cephia D Toomer

(74) *Attorney, Agent, or Firm* — Brinks Hofer Gilson & Lione

(57) ABSTRACT

The present lipid-based wax compositions commonly include a polyol fatty acid ester component (made up of partial and/or completely esterified polyols). Generally, at least a portion of the polyol fatty acid ester has been subjected to a transesterification reaction. Lipid-based wax compositions having a melting point of about 48° C. to about 75° C. can be particularly advantageous for use in forming candles. The wax may contain other components such as mineral wax, plant wax, insect wax, and/or other components. The polyol fatty acid ester component can include triacylglycerols such as those derived from plant oils (soybean oil, palm oil, etc.). The polyol ester component may be characterized based on one or more of its physical characteristics, such as SFI-40, SFI-10, typical crystal structure, IV, melting curve, and/or other properties.

11 Claims, 6 Drawing Sheets

U.S. PATENT DOCUMENTS 4,134,718 A 1/1979 Kayfetz et al.
4,292,088 A 9/1981 Scheuffgen et al.
4,293,345 A 10/1981 Zeilstra et al.
4,314,915 A 2/1982 Wiegers et al.
4,390,590 A 6/1983 Saunders et al.
4,411,829 A 10/1983 Schulte-Elte et al.
4,434,306 A 2/1984 Kobayashi et al.
4,507,077 A 3/1985 Sapper
4,545,941 A 10/1985 Rosenburg
4,554,107 A 11/1985 Takao
4,567,548 A 1/1986 Schneeberger
4,608,011 A 8/1986 Comstock
4,614,625 A 9/1986 Wilson
4,623,488 A 11/1986 Takao
4,714,496 A 12/1987 Luken, Jr. et al.
4,759,709 A 7/1988 Luken, Jr. et al.
4,813,975 A 3/1989 Poulina et al.
4,842,648 A 6/1989 Phadoemchit et al.
4,855,098 A 8/1989 Taylor
4,923,708 A 5/1990 Given, Jr.
5,171,329 A 12/1992 Lin
5,258,197 A 11/1993 Wheeler et al.
5,338,187 A 8/1994 Elharar
5,380,544 A 1/1995 Klemann et al.
5,578,089 A 11/1996 Elsamaloty
5,660,865 A 8/1997 Pedersen et al.
5,700,516 A 12/1997 Sandvick et al.
5,723,137 A 3/1998 Wahle et al.
5,753,015 A 5/1998 Sinwald et al.
5,843,194 A 12/1998 Spaulding
5,885,600 A 3/1999 Blum et al.
5,888,487 A 3/1999 Baumoeller et al.
6,001,286 A 12/1999 Sleeter
6,019,804 A 2/2000 Requejo et al.
6,022,402 A 2/2000 Stephenson et al.
6,063,144 A 5/2000 Calzada et al.
6,099,877 A 8/2000 Schuppan
6,103,308 A 8/2000 Floyd et al.
6,106,597 A 8/2000 Starks et al.
6,123,979 A 9/2000 Hepburn et al.
6,127,326 A 10/2000 Dieckmann et al.
6,132,742 A 10/2000 Le Bras et al.
6,156,369 A 12/2000 Eger et al.
6,201,053 B1 3/2001 Dieckmann et al.
6,214,918 B1 4/2001 Johnson et al.
6,224,641 B1 5/2001 Matzat et al.
6,238,926 B1 5/2001 Liu et al.
6,255,375 B1 7/2001 Michelman
6,258,965 B1 7/2001 O'Lenick, Jr.
6,262,153 B1 7/2001 Webster et al.
6,276,925 B1 8/2001 Varga
6,277,310 B1 8/2001 Sleeter
6,284,007 B1 9/2001 Tao
6,497,735 B2 12/2002 Tao
6,503,077 B2 1/2003 Orth et al.
6,503,285 B1 1/2003 Murphy
6,582,748 B1 6/2003 Loh et al.
6,586,506 B2 7/2003 Webster et al.
6,599,334 B1 7/2003 Anderson
6,645,261 B2 11/2003 Murphy et al.
6,673,763 B1 1/2004 Hansen et al.
6,730,137 B2 5/2004 Pesu et al.
6,733,548 B2 5/2004 Rasmussen et al.
6,758,869 B2 7/2004 Roeske et al.
6,770,104 B2 8/2004 Murphy
6,773,469 B2 8/2004 Murphy
6,797,020 B2 9/2004 Murphy
6,824,572 B2 11/2004 Murphy
6,846,573 B2 1/2005 Seydel
6,852,140 B1 2/2005 Roeske
6,943,262 B2 9/2005 Kodali et al.
7,037,439 B2 5/2006 Tavares
7,128,766 B2 10/2006 Murphy et al.
7,176,171 B2 2/2007 Nieendick et al.
7,192,457 B2 * 3/2007 Murphy et al. ..... 44/275
7,217,301 B2 5/2007 Murphy et al.
7,387,649 B2 6/2008 Tao
7,462,205 B2 12/2008 Murphy
7,510,584 B2 3/2009 Cap
7,569,084 B2 8/2009 Tao et al.
7,588,607 B1 9/2009 Cap
7,601,184 B2 10/2009 Tischendorf
7,637,968 B2 12/2009 Murphy
7,833,294 B2 * 11/2010 Murphy et al. ..... 44/275
2001/0013195 A1 8/2001 Tao
2001/0051680 A1 12/2001 Webster et al.
2002/0005007 A1 1/2002 Roeske et al.
2002/0144455 A1 10/2002 Bertrand et al.
2002/0157303 A1 10/2002 Murphy et al.
2003/0008257 A1 1/2003 Tao
2003/0017431 A1 1/2003 Murphy
2003/0022121 A1 1/2003 Biggs
2003/0046860 A1 3/2003 Tiffany et al.
2003/0057599 A1 3/2003 Murphy et al.
2003/0061760 A1 4/2003 Tao et al.
2003/0091949 A1 5/2003 Pesu et al.
2003/0110683 A1 6/2003 Murphy
2003/0134244 A1 7/2003 Gray et al.
2003/0198826 A1 10/2003 Seydel
2003/0207971 A1 11/2003 Stuart, Jr. et al.
2003/0213163 A1 11/2003 Berger et al.
2004/0000088 A1 1/2004 Wesley
2004/0037859 A1 2/2004 Cecchi et al.
2004/0047886 A1 3/2004 Murphy et al.
2004/0076732 A1 4/2004 Valix
2004/0088907 A1 5/2004 Murphy
2004/0088908 A1 5/2004 Murphy
2004/0138359 A1 7/2004 Dinkelaker et al.
2004/0200136 A1 10/2004 Tao et al.
2004/0221503 A1 11/2004 Murphy et al.
2004/0221504 A1 11/2004 Murphy
2004/0250464 A1 12/2004 Rasmussen et al.
2005/0014664 A1 1/2005 Nadolsky et al.
2005/0060927 A1 3/2005 Murphy
2005/0095545 A1 5/2005 Tischendorf
2005/0123780 A1 6/2005 Seydel
2005/0158679 A1 7/2005 Chen et al.
2005/0269728 A1 12/2005 Roos
2006/0236593 A1 10/2006 Cap
2006/0272199 A1 12/2006 Licciardello et al.
2006/0272200 A1 12/2006 Murphy et al.
2007/0006521 A1 1/2007 Licciardello et al.
2007/0006522 A1 1/2007 Tao
2007/0039237 A1 2/2007 Murphy et al.
2007/0056211 A1 3/2007 Li et al.
2007/0144058 A1 6/2007 Chen et al.
2007/0151480 A1 7/2007 Bloom et al.
2007/0270621 A1 11/2007 Millis et al.
2007/0282000 A1 12/2007 Murphy et al.
2008/0027194 A1 1/2008 Schrodi
2008/0064891 A1 3/2008 Lee
2008/0138753 A1 6/2008 Tao et al.
2008/0145808 A1 6/2008 Lee
2008/0206411 A1 8/2008 Nielsen
2008/0307696 A1 12/2008 Wu et al.
2009/0048459 A1 2/2009 Tupy et al.
2009/0119977 A1 5/2009 Murphy
2009/0217568 A1 9/2009 Murphy et al.
2009/0259065 A1 10/2009 Abraham et al.
2009/0264672 A1 10/2009 Abraham et al.
2010/0024281 A1 2/2010 Lemke et al.
2010/0044924 A1 2/2010 Cap
2010/0047499 A1 2/2010 Braksmayer et al.
2010/0132250 A1 6/2010 Uptain et al.
2010/0145086 A1 6/2010 Schrodi et al.
2010/0205851 A1 8/2010 Uptain et al.

FOREIGN PATENT DOCUMENTS

EP 0536861 A1 4/1993
EP 0545715 A1 6/1993
EP 0685554 A1 12/1995
EP 0811664 A1 12/1997
EP 1801096 A1 6/2007
JP 56-32550 A 4/1981
JP 04-59897 A 2/1992
JP 06-009987 A 1/1994
JP 09-014574 A 1/1997

| | | | |
|---|---|---|---|
| WO | WO 92/000269 | | 1/1992 |
| WO | WO 96/00815 | A1 | 1/1996 |
| WO | WO 96/14373 | A1 | 5/1996 |
| WO | WO 98/45390 | A1 | 10/1998 |
| WO | WO 99/27043 | A1 | 6/1999 |
| WO | WO 02/030386 | A1 | 4/2002 |
| WO | WO 02/092736 | A1 | 11/2002 |
| WO | WO 03/012016 | A1 | 2/2003 |
| WO | WO 03/051134 | A2 | 6/2003 |
| WO | WO 03/057983 | A1 | 7/2003 |
| WO | WO 03/070865 | A1 | 8/2003 |
| WO | WO 03/104348 | A1 | 12/2003 |
| WO | WO 2004/033388 | A1 | 4/2004 |
| WO | WO 2004/083310 | A1 | 9/2004 |
| WO | WO 2004/101720 | A1 | 11/2004 |
| WO | WO 2005/042655 | A2 | 5/2005 |
| WO | WO 2006/041011 | A1 | 4/2006 |
| WO | WO 2006/076364 | A2 | 7/2006 |
| WO | WO 2007/002999 | A1 | 1/2007 |
| WO | WO 2008/008420 | A1 | 1/2008 |
| WO | WO 2008/010961 | A2 | 1/2008 |
| WO | WO 2008/048520 | A2 | 4/2008 |
| WO | WO 2008/103289 | A1 | 8/2008 |
| WO | WO 2008/140468 | A2 | 11/2008 |
| WO | WO 2008/151064 | A1 | 12/2008 |
| WO | WO 2008/157436 | A1 | 12/2008 |

OTHER PUBLICATIONS

Bell et al., "Sperm Oil Replacements: Synthetic Wax Esters from Selectively Hydrogenated Soybean and Linseed Oils," Journal of the American Chemical Society, Jun. 1997, vol. 54, pp. 259-263.

Erhan et al. , "Drying Properties of Metathesized Soybean Oil," Journal of American Oil Chemists' Society, AOCS Press, vol. 74, No. 6, 1997, pp. 703-706.

Frahm, "Harvest Lights: The only soy-based candle, a bright idea," available at http://www.extension.uiuc.edu/~stratsoy/new/news/html/909166253,html, Oct. 23, 1998, 2 pages.

Mol, "Applications of Olefin Metathesis in Oleochemistry: An Example of Green Chemistry," Green Chemistry, Royal Society of Chemistry, Cambridge, GB, vol. 4, 2002, pp. 5-13.

Oliefabrik et al., "Paper coating", Research Disclosure Journal, Dec. 1996, 2 pages.

Orso, "New Use for Soybeans Has Bright Future," available at http://www.unitedsoybean.com/news/nr981014.htm, Oct. 14, 1998, 2 pages.

Rezaei, "Hydrogenated Vegetable Oils as Candle Wax," J. of the Am. Oil Chemists' Society, vol. 12, No. 79, pp. 1241-1247 (Dec. 2002).

Noller, Chemistry of Organic Compounds, W.B. Saunders Company, 2nd Ed., 1957, pp. 181 and 192.

Tao, "Development of Vegetable Lipid-based Candles," available at http://abe.www.ecn.purdue.edu/ABE/Research/research94/REPORT.94.Book_68.htmls, 1994, 2 pages.

In Business, "America's Shining Example of Sustainable Business," available at http://www.candleworks.org, Mar./Apr. 1998, 3 pages.

Pages from Bitter Creek Candle Supply, Inc., website (http://www.execpc.com/~bcsupply) now at http://www.candlesupply.com, available at least by Jun. 29, 2000, 9 pages.

Pages from Ecowax, Nature's Gift, Inc., website (http://nglwax.com/ecowax.htm), available at least by Jul. 5, 2000, 3 pages.

Pages from Heartland Candleworks website, available at www.candleworks.org, available at least by Feb. 11, 2000, 4 pages.

Purdue Agriculture News, Purdue May Agriculture & Natural Resources Package, available at http://purduenews.uns.purdue.edu/UNS/paks/agpak.digest.9605.html, May 1996, 3 pages.

Purdue News, "Purdue students put the 'happy' back into birthday candles," available at http://www.purdue.edu/UNS/html4ever/9611.Schweitzer.candles.html, Nov. 1996, 3 pages.

Purdue News, "Purdue students put the 'happy' back into birthday candles," available at http://www.purdue.edu/UNS/html4ever/9604.Schweitzer.candles.html, May 1996, 2 pages.

Purdue University School of Agriculture, 1998 Farm Progress Show, available at http://www.admin.ces.purdue.edu/anr/98fps/fpspix/930.html, 1998, 4 pages.

International Search Report for International Application No. PCT/US2004/014090, dated Oct. 20, 2004, 3 pages.

International Preliminary Report on Patentability for International Application No. PCT/US2004/014090, dated Nov. 11, 2005, 6 pages.

Examination Report from counterpart Canadian Application No. 2525088, dated Apr. 8, 2011, 2 pages.

* cited by examiner

WAX AND WAX-BASED PRODUCTS

CROSS-REFERENCE TO RELATED PATENT APPLICATIONS

This application is a divisional of U.S. patent application Ser. No. 11/502,977, filed Aug. 11, 2006 now U.S. Pat. No. 7,833,294, which is a divisional of U.S. patent application Ser. No. 10/434,447, filed May 8, 2003, now U.S. Pat. No. 7,192,457, dated Mar. 20, 2007. The contents of the aforementioned applications are incorporated herein by reference in their entirety.

BACKGROUND

For a long time, beeswax was has been in common usage as a natural wax for candles. Some time ago, paraffin came into existence, in parallel with the development of the petroleum refining industry. Paraffin is produced from the residue leftover from refining gasoline and motor oils. Paraffin was introduced as a bountiful and low cost alternative to beeswax, which had become more and more costly and in more and more scarce supply.

Today, paraffin is the primary industrial wax used to produce candles and other wax-based products. Conventional candles produced from a paraffin wax material typically emit a smoke and can produce a bad smell when burning. In addition, a small amount of particles ("particulates") can be produced when the candle burns. These particles may affect the health of a human when breathed in. A candle that has a reduced amount of paraffin would be preferable.

Accordingly, it would be advantageous to have other materials which can be used to form clean burning base wax for forming candles. If possible, such materials would preferably be biodegradable and be derived from renewable raw materials. The candle base waxes should preferably have physical characteristics, e.g., in terms of melting point, hardness and/or malleability, that permit the material to be readily formed into candles having a pleasing appearance and/or feel to the touch, as well as having desirable olfactory properties.

Additionally, there are several types of candles, including taper, votive, pillar, container candles and the like, each of which places its own unique requirements on the wax used in the candle. For example, container candles, where the wax and wick are held in a container, typically glass, metal or the like, require lower melting points, specific burning characteristics such as wider melt pools, and should desirably adhere to the container walls. The melted wax should preferably retain a consistent appearance upon resolidification.

In the past, attempts to formulate candle waxes from vegetable oil-based materials have often suffered from a variety of problems. For example, relative to paraffin-based candles, vegetable oil-based candles have been reported to exhibit one or more disadvantages such as cracking, air pocket formation, and a natural product odor associated with soybean materials. Various soybean-based waxes have also been reported to suffer performance problems relating to optimum flame size, effective wax and wick performance matching for an even burn, maximum burning time, product color integration and/or product shelf life. In order to achieve the aesthetic and functional product surface and quality sought by consumers of candles, it would be advantageous to develop new vegetable oil-based waxes that overcome as many of these deficiencies as possible.

Candles are often prepared by means of melt-processing. For purposes of commercial-scale manufacture, there can be economic advantage in the prospective utilization of wax powder compression technology. However, the production of a superior candle product by wax powder compression is not readily achieved. The compression-molding of a wax powder is affected by formulation variables, such as wax melting point, particle size distribution, the number and quantity of additives such as air fresheners and colorants, and the like, and process variables, such as compression time and the degree of compression.

There is continuing interest in the development of additional wax materials and candle products which can be manufactured by powder compression technology.

SUMMARY

The present compositions relate to waxes which may be used in candles. The waxes typically have a low paraffin content (less than 50%, and typically much lower amounts). The candles are typically formed from a ester-based waxes, such as vegetable oil-based wax, a biodegradable material produced from renewable resources. Since the candles may be formed from a material with a low paraffin content and may be substantially devoid of paraffin (e.g. contain no more than about 0.5 wt. % paraffin), the candles are generally clean burning, emitting very little soot. The combination of low soot emission, biodegradability and production from renewable raw material makes the present waxes and candles particularly environmentally friendly products.

The present wax is typically solid at room temperature, firm but not brittle, generally somewhat malleable, has no free oil visible and is particularly suited for use in forming many types of candles, such as container candles, votive candles, and pillar candles. The present waxes are also generally capable of providing consistent characteristics, such as appearance, upon cooling and resolidification (e.g., after being burned in a candle) of the melted wax. In addition, it is desirable that the wax is capable of being blended with natural color additives to provide an even, solid color distribution. It is also desirable that the wax is capable of being blended with other additives, such as perfumes or other fragrances, and preferably be capable of exhibiting good fragrance throw when the wax/fragrance blend is burned.

The present lipid-based wax compositions commonly include a polyol fatty acid ester component (made up of partial and/or completely esterified polyols), at least a portion of which have been subjected to a transesterification reaction. The transesterification reaction may be catalyzed by an enzyme or by a chemical catalyst (e.g., a basic catalyst). Very often the polyol fatty acid ester component has been subjected to an interesterification reaction, e.g., by treatment with a basic catalyst, such as a sodium alkoxide. For example the polyol ester component may include a polyol fatty acid ester component formed by a process which comprises interesterifying a polyol fatty acid ester precursor mixture. Due to their desirable melting characteristics, the polyol ester based waxes having a melting point of about 48° C. to about 75° C. can be particularly advantageous for use in forming candles. Commonly, the polyol ester based waxes include at least about 51 wt. % of a polyol fatty acid ester component (and more desirably at least about 70 wt. %). More typically, the wax includes at least about 51 wt. % of a completely esterified polyol ester component (e.g., a mixture of triacylglycerol compounds optionally combined with complete esters of other polyols), and preferably includes at least 70 wt. % of the completely esterified polyol. Very often, the completely esterified polyol ester component has been subjected to interesterification conditions. The interesterification of a mixture of completely esterified polyols may be conducted on a mixture which also includes one or more polyol partial esters, e.g., a fatty acid monoglyceride and/or fatty acid diglyceride.

In some embodiments, the wax composition may include other components such as a mineral wax, a free fatty acid, a solid natural wax (such as plant wax or insect wax), and/or other renewable resource based wax. These waxes are preferably only present in the composition up to about 49% by weight, and often in much lower amounts. The mineral wax may be a petroleum wax such as a medium paraffin wax, a microcrystalline paraffin wax and/or a petroleum wax obtained from crude oil refined to other degrees. In another embodiment, the wax composition includes no more than about 25 wt. % of the alternate waxes. In still another embodiment, the wax composition includes no more than about 10% by weight of the alternate waxes.

The present waxes preferably include any number of characteristics. For instance, a glycerol based portion of the wax may maintain a generally β' crystal structure when subjected to normal candle heating and cooling conditions. The wax may include no more than about 1 wt. % free fatty acids and/or no more than about 1 wt. % particulate matter. The wax may include no more than about 5 to 15 wt. % 16:0 fatty acids in its fatty acid profile, no more than about 10 wt. % fatty acids having hydroxyl groups, and/or no more than about 25 wt. % fatty acids having less than 16 carbon atoms or more than 18 carbon atoms. In other embodiments, the wax composition may include at least about 51 wt. % of the polyol fatty acid ester component, and preferably include at least about 51 wt. % of a completely esterified polyol fatty acid ester component. The wax may also include additives which impart useful characteristics such as color or scent. The wax can preferably pass a slump test; preferably passing it at least 120° F. The wax typically has an SFC-40 of at least about 15. Waxes according to these embodiments commonly do not have large spikes in their melting curves (which can be determined by an up-heat melting curve measured by DSC). The DSC curves for the precursor mixtures shown in FIGS. 5 and 6 are examples of triacylglycerol mixtures which exhibit large spikes in their up-heat melting curves.

Waxes suitable for use as pillar candles can have a melting point of about 55° C. to about 70° C., and commonly have an IV of about 15-50. The wax may be in a particulate form to facilitate forming waxes by compression molding or to be included in candle making kits. Waxes suitable for use in making votive candles commonly have a melting point of about 52° C. to about 60° C. These waxes commonly have an IV of about 35-65. Waxes suitable for use in forming container candles typically have a melting point of about 48° C. to about 57° C. Such waxes generally have an IV of about 45-70. Further, these container candle waxes preferably have an SFC-10 that is at least twice its SFC-40.

It has been reported that a candle with a string-less wick can be formed by suspending fine granular or powdered material, such as silica gel flour or wheat fiber in a vegetable oil such as soybean oil, cottonseed oil and/or palm oil. The inclusion of particulate material in a candle wax can result in a two phase material and alter the visual appearance of a candle. Accordingly, the present polyol ester-based wax is preferably substantially free (e.g., includes no more than about 0.5 wt. %) of particulate material. As used herein, the term "particulate material" refers to any material that will not dissolve in the polyol ester component of the wax, when the wax is in a molten state.

The polyol ester-based wax may also include minor amounts of other additives to modify the properties of the waxy material. Examples of types of additives which may commonly be incorporated into the present candles include colorants, fragrances (e.g., fragrance oils), insect repellants and migration inhibitors.

If the present wax is used to produce a candle, the same standard wicks that are employed with other waxes (e.g., paraffin and/or beeswax) can be utilized. In order to fully benefit from the environmentally-safe aspect of the present wax, it is desirable to use a wick which does not have a metal core, such as a lead or zinc core. One example of a suitable wick material is a braided cotton wick.

The present candles may be formed by a method which includes heating the polyol ester-based wax to a molten state and introduction of the molten polyol ester-based wax into a mold which includes a wick disposed therein. The molten polyol ester-based wax is cooled in the mold to solidify the wax.

Alternatively, the present candles may be formed by compression molding. This process is often carried out be introducing wax particles into a mold and applying pressure. The resulting candles may be over-dipped, in the same type or a different type of wax than used in the compression molding process.

DETAILED DESCRIPTION OF THE PREFERRED EMBODIMENTS

Figure 1:
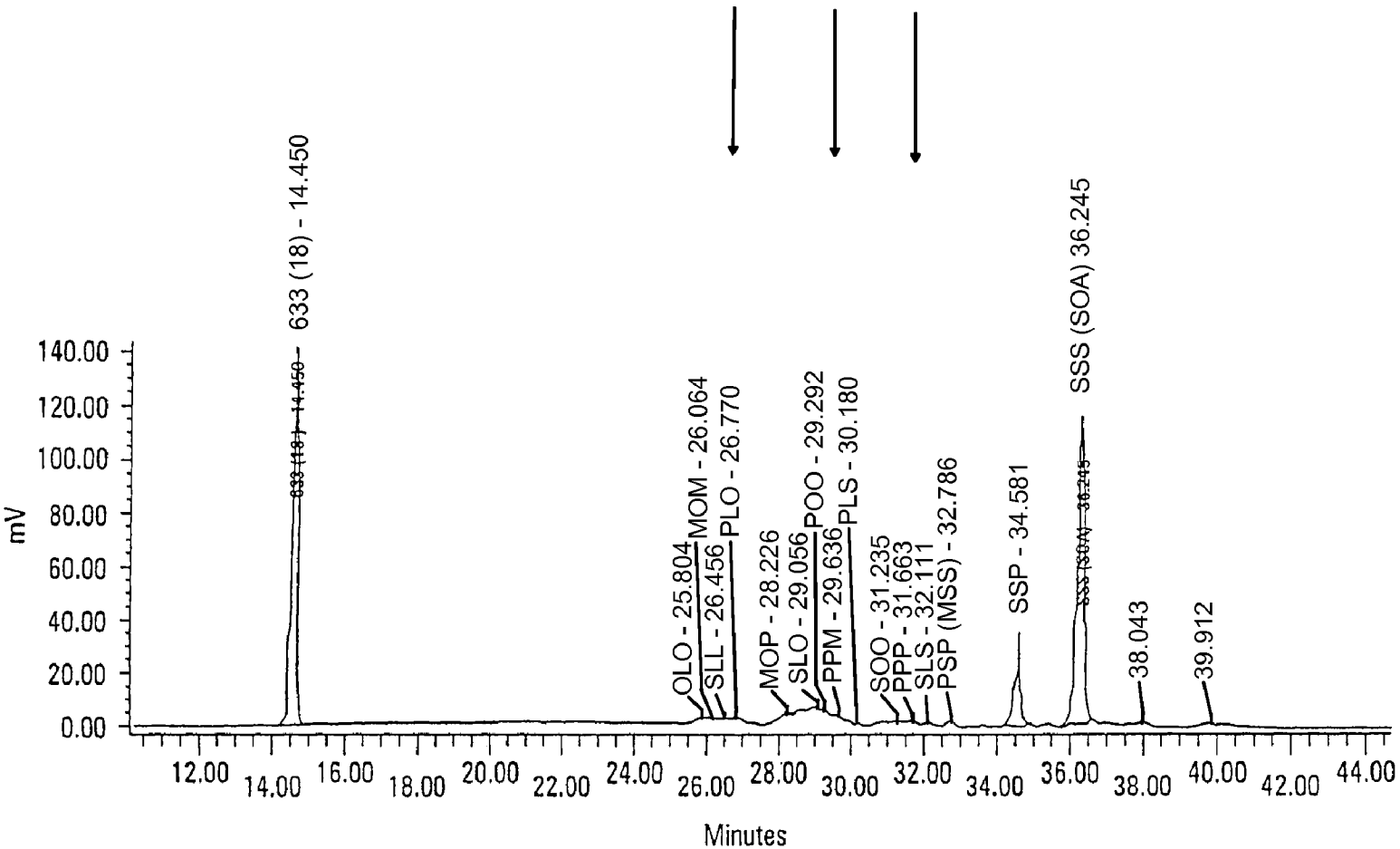
FIG. 1 shows a triacylglycerol profile ("TAG profile") of the Sample 2 Precursor Mixture (of Table 1) prior to interesterification.

As used herein, a "fully hydrogenated" vegetable oil refers to a vegetable oil which has been hydrogenated to an Iodine Value of no more than about 5. The term "hydrogenated" is used herein to refer to fatty acid ester-based stocks that are either partially or fully hydrogenated. Instead of employing a highly hydrogenated vegetable oil, a highly unsaturated triacylglycerol material derived from precipitating a hard fat fraction from a vegetable oil may be employed. Hard fat fractions obtained in this manner are predominantly composed of saturated triacylglycerols and mono unsaturated triacylglycerols.

Other polyol esters can be used in the transesterification of vegetable oils. As used herein, "polyol esters" refers to esters produced from polyols containing from two to about 10 carbon atoms and from two to six hydroxyl groups. Preferably, the polyols contain two to four hydroxyl moieties. Non-limiting examples of polyols include 1,2-propanediol, 1,3-propanediol, 1,2-butanediol, 1,3-butanediol, 2,3-butanediol, 2-ethyl-1,3-propanediol, 2-ethyl-2-butyl-1,3-propanediol, neopentyl glycol, 2,2,4-trimethyl-1,3-pentanediol, trimethylolpropane (TMP), and pentaerythritol. Neopentyl glycol, TMP, and pentaerythritol are particularly useful polyols. Polyol esters can be produced by transesterification of a polyol with methyl esters of fatty acids. The fatty acid may be a branched chain fatty acid. For example, 2-ethyl hexanoic acid is a potential branched chain fatty acid. Suitable TMP esters can include, for example, TMP tri(2-ethyl hexanoate), TMP triheptanoate (TMPTH), TMP tricaprylate, TMP tricaproate, and TMP tri(isononanoate).

The mixture of acids isolated from complete hydrolysis of the polyol ester in a specific sample is referred herein to as the "acid composition" of that sample. By the term "acid composition" reference is made to the identifiable acid residues in the various esters. The distribution of acids in a particular mixture of esters may be readily determined by methods known to those skilled in the art.

In general, oils extracted from any given plant or animal source comprise a mixture of triacylglycerols characteristic of the specific source. The mixture of fatty acids isolated from complete hydrolysis of the triacylglycerols and/or other fatty acid esters in a specific sample are referred herein to as the "fatty acid composition" of that sample. By the term "fatty acid composition" reference is made to the identifiable fatty acid residues in the various esters. The distribution of fatty acids in a particular oil or mixture of esters may be readily determined by methods known to those skilled in the art, e.g., via gas chromatography or conversion to a mixture of fatty acid methyl esters followed by analysis by gas chromatography.

As employed herein, the term "interesterified" when used in conjunction with "polyol fatty acid ester", "triacylglycerol" or other polyol ester refers to an ester composition which has been treated in a manner that results in the exchange of at least a portion of the acyl groups in the polyol esters present with other acyl groups, and/or other esters present. The reaction may employ a catalyst which may be a chemical reagent or a enzymatic catalyst, such as a lipase. As employed herein, the term "fully interesterified" when used in conjunction with "polyol fatty acid ester", "triacylglycerol" or other polyol ester refers to an ester composition for which the melting point when further treated with sodium methoxide under the conditions described in Example 1 herein will change by no more than about 3° F.

The polyol ester component may include a partial fatty acid ester of one or more polyols and/or a polyol which is fully esterified with fatty acids ("complete polyol fatty acid ester"). Examples of complete polyol fatty acid esters include triacylglycerols, propyleneglycol diesters and tetra esters of pentaerythritol. Examples of suitable polyol partial esters include fatty acid monoglycerides, fatty acid diglycerides and sorbitan partial esters (e.g., diesters and triesters of sorbitan). The polyol typically contains from 2 to 6 carbon atoms and 2 to 6 hydroxyl groups. Examples of suitable polyols include glycerol, ethyleneglycol, propyleneglycol, pentaerythritol, sorbitan and sorbitol.

The method(s) described herein can be used to provide candles from triglycerol-based materials having a melting point and/or solid fat content which imparts desirable molding and/or burning characteristics. The solid fat content as determined at one or more temperatures is a measure of the fluidity properties of a triglycerol stock. Solid fat content ("SFC") can be determined by Differential Scanning calorimetry ("DSC") using the methods well known to those skilled in the art. Fats with lower solid fat contents have a lower viscosity, i.e., are more fluid, than their counterparts with high solid fat contents.

The melting characteristics of the triglycerol-based material may be controlled based on its solid fat content to provide a material with desirable properties for forming a candle. Although the solid fat content is generally determined by measurement of the solid content of a triglycerol material as a function over a range of 5 to 6 temperatures, the triglycerol-based materials described herein can be characterized in terms of their solid fat contents at 10° C. ("SFC-10") and/or 40° C. ("SFC-40").

Esterification reactions are the processes by which an acyl group is added onto a polyol, such as glyceride, monoglyceride, diglyceride, triglyceride, polyhydroxyl alcohol, and the like, to form either a partial polyol ester or a completely esterified polyol ester. The acyl group(s) of a polyol ester can be replaced and/or repositioned by reacting the polyol ester with another ester (e.g., another polyol ester and/or a simple alkyl ester, such as a fatty acid alkyl ester) in a transesterification reaction. As employed herein, transesterification refers to a chemical reaction which results either in the exchange of an acyl group between two positions of a polyol polyester or of the exchange of an acyl group in one ester compound with an acyl group in a second ester compound or a carboxylic acid. Interesterification as employed herein refers to a transesterification reaction, which results in the exchange of acyl groups between a mixture of different ester compounds as well as between ester groups on different positions of a polyol polyester. As used herein, the term polyol polyester refers to any ester compound which contains more than one ester group. The polyols employed in the polyol esters used in the present waxes commonly have from 2 to 6 carbon atoms and 2 to 6 hydroxyl groups. The interesterification reaction may be run until the distribution of ester groups in a polyol mixture is substantially that predicted from a thermodynamic distribution of the ester groups, both within individual polyol ester compounds and between differing polyol esters. The resulting distribution of the ester groups is generally very similar to the distribution predicted from a randomized distribution (statistical distribution) of the ester groups. A mixture of polyol ester compounds which has such a randomized distribution of ester groups will not exhibit any substantial change in the distribution of its chemical components when subjected to further interesterification in the presence of a basic catalyst, such as sodium methoxide. Such a mixture of esters is referred to herein as a fully interesterified polyol ester and after being subjected to further base catalyzed transesterification conditions will not exhibit a change in its melting point of more than about 3° F. (no more than about 1.5° C.).

The acyl group in the present polyol esters can be derived from any number of sources. For instance, it can be derived from monoglyceride, diglyceride, triglyceride, ester, free fatty acid, and/or other source of acyl groups. The non-acyl portion ("R group") of the acyl group can be straight or branched, saturated or unsaturated, and/or contain non-carbon substituents including oxygen (such as hydroxyl groups), sulfur and/or nitrogen. Typically the acyl group includes an R group which is an alkyl group, an alkenyl group, or a hydroxy substituted alkyl group. The majority of the R groups are typically straight chain saturated hydrocarbon groups ("straight chain alkyl groups") and/or straight chain monounsaturated hydrocarbon groups ("straight chain alkenyl groups").

Lipases are typically obtained from prokaryotic or eukaryotic microorganisms and typically fall into one of three categories (Macrae, A. R., J.A.O.C.S.60:243A-246A (1983); "Macrae, 1983"). A first category includes nonspecific lipases capable of releasing or binding any fatty acid from or to any glyceride position. These lipases are similar to chemical processes. Such lipases have been obtained from *Candida cylindracae, Corynebacterium acnes* and *Staphylococcus*

*aureus* (Macrae, 1983). A second category of lipases only adds or removes specific fatty acids to or from specific glycerides. Thus, these lipases generally tend to be useful for producing or modifying specific glycerides. Such lipases have been obtained from *Geotrichum candidium* and *Rhizopus, Aspergilus*, and *Mucor genera* (Macrae, 1983). A third category of lipases catalyze the removal or addition of fatty acids from the glyceride carbons on the end in the 1- and 3-positions. Such lipases have been obtained from *Thermomyces lanuginosa, Rhizomucor miehei, Aspergillus niger, Mucor javanicus, Rhizopus delemar*, and *Rhizopus arrhizus* (Macrae, 1983).

One embodiment is directed to a lipid-based wax composition having a melting point of about 48° C. to about 75° C. and including a polyol fatty acid ester component formed by a process which includes interesterifying a polyol fatty acid ester precursor. The polyol fatty acid ester component can include a fully esterified polyol fatty acid ester component. The wax composition commonly includes at least about 51 wt. % of the fully esterified polyol fatty acid ester component, and more commonly at least about 70 wt. %. The fully esterified polyol fatty acid ester component can include triacylglycerol. The wax preferably has a melting point of about 53° C. to 70° C., or about 50° C. to 65° C., or about 48° C. to 58° C. The wax preferably has an SFC-40 of at least about 15, and more preferably at least about 20. For waxes designed to be used in container candles, it may be desirable to have an SFC-10 that is at least about twice as much as its SFC-40 (i.e., the SFC-10:40 ratio is at least about 2.0).

Another embodiment is directed to a candle made from a triacylglycerol containing wax. The candle includes a wick and a wax. The wax has a melting point of about 45° C. to about 75° C. and includes a triacylglycerol component having a fatty acid composition which includes stearic acid. The triacylglycerol component preferably has a percent concentration by weight of SSS-TAG which is equal to the cube of a fractional concentration by weight of stearic acid in the fatty acid profile+E wt. %. E can be selected to be no more than a preset amount, or no more than a percentage of the SSS-TAG concentration. E is preferably selected to be no more than about 5 or 7 wt. %, and desirably less than or equal to 3 wt. %. The wax preferably includes at least about 51 wt. % of the triacylglycerol component. Stearic acid may often makeup about 30 wt. % or more of the fatty acid composition of the triacylglycerol component. The 1,2:1,3-S ratio in the triacylglycerol component is preferably at least 1.5; the 1,2:1,3-S ratio being the percent concentration by weight of 1,2-S-3-X-triacylglycerol divided by the percent concentration by weight of 1,3-S-2-X-triacylglycerol (the ratio also being capable of being written as SSQ-TAG:SQS-TAG).

Another embodiment is directed to a candle comprising a wick and a wax. The wax preferably has a melting point of about 45° C. to about 75° C. and includes a fully interesterified polyol fatty acid ester component. The polyol fatty acid ester component is preferably a triacylglycerol component.

Another embodiment provides a lipid-based wax suitable for use as a candle wax. The lipid-based wax includes a completely esterified polyol fatty acid ester component. The wax has a melting point of about 50° C. to about 60° C.; an Iodine Value of about 40 to 75; and an SFC at 10° C. that is at least about twice that of the SFC at 40° C.

Another embodiment is directed to another polyol-based wax suitable for use as a candle wax. The polyol-based wax includes a complete polyol fatty acid ester component. The wax has a melting point of about 45° C. to 65° C. and an SFC-40 of at least about 15. More preferably, the wax has an SFC-40 of at least about 20. The wax preferably has an Iodine Value of about 40 to 75.

Another embodiment provides an ester-based composition which includes at least about 51 wt. % of an interesterified polyol fatty acid ester. The composition can also include a wax component such as an insect wax or other naturally occurring wax and/or a petroleum wax. The ester-based wax can also have a melting point of about 45° C. to 60° C. and/or an SFC-40 of at least about 20.

Another embodiment is directed to a candle having a wick and a wax. The wax has a melting point of about 45° C. to about 75° C. and includes a triacylglycerol component. The triacylglycerol component preferably has a fractional concentration by weight of tri(HC)-TAG (expressed as a percentage) which is equal to the cube of the percent concentration by weight of HC in the fatty acid profile+E wt. %. HC represents the fatty acid which is present in the greatest amount in the fatty acid composition of the triacylglycerol component, and tri(HC)-TAG is a triacylglycerol having three HC fatty acid acyl groups.

Another embodiment is directed to a method for forming a wax. The method includes creating a precursor mixture which includes at least (a) a completely esterified polyol ester such as triacylglycerol and (b) glycerin and/or other polyol (e.g. propylene glycol and/or sorbitan). The method further includes interesterifying the precursor mixture, preferably until the mixture is fully interesterified. The method may further include removing portions of the resulting mixture, such as free fatty acids, glycerin molecules, or other portions.

Another embodiment is directed to a polyol-based wax suitable for use as a candle wax. The polyol-based wax includes a completely esterified polyol fatty acid ester component. The wax preferably has a melting point of about 130° F. to 155° F. (about 54° C. to 68° C.), and an SFI-40 of at least about 40. The wax also preferably has an Iodine Value of about 20 to 45.

Another embodiment provides a lipid-based wax suitable for use as a candle wax. The lipid-based wax includes at least about 50 wt. % of a fully interesterified polyol fatty acid ester component, and more typically at least about 70 wt. %. The lipid-based wax preferably has a melting point of about 130° F. to 155° F. (about 54° C. to 68° C.) and/or an SFI-40 of at least about 40. The lipid-based wax may include a polyol fatty acid partial ester, and may include up to about 20 wt. % of a polyol fatty acid partial ester. The lipid-based wax may further include a mineral wax, an insect wax, some other naturally occurring wax. The lipid-based wax can also include a free fatty acid component. In some circumstances, the fatty acid composition of the lipid-based wax does not include more than about 15 wt. % palmitic acid. The fatty acid composition of the lipid-based wax often includes no more than about 1.0 wt. % 18:3 fatty acid. The lipid-based wax preferably has a slump temperature of at least about 118° F.

Another embodiment is directed to a candle having a wick and a wax. The wax preferably has a melting point of about 45° C. to about 75° C. The wax includes a triacylglycerol component formed by a process which includes interesterifying a precursor mixture. The precursor mixture can include triglycerides, fatty acid monoglycerides, fatty acid diglycerides, fatty acid alkyl esters, free fatty acids, glycerin, and/or other esters or polyols. Preferably, the precursor mixture contains at least about 70 wt. % triacylglycerols.

Transesterification of two polyol esters can randomize the distribution of fatty acids among the polyol backbones—completely, between specific hydroxyl groups of the polyol (e.g. between the 1 and 3 positions of the glycerol), and/or between specific polyols or esters. The resulting transesterified products have properties different from each of the original polyol esters. Various interesterification techniques can be used to add useful properties to polyol ester-based waxes. For example, base can be added to a mixture of ester compounds to allow random interchange of acyl groups between the various esters. Alternatively, enzymes and other biological molecules can be added to facilitate interesterification. Other interesterification methods may also be used.

Interesterification can be used to give waxes more desirable properties. For instance, interesterification tends to give compounds a smoother melting curve. This tends to allow for a smoother melt and cooling process. Interesterification can also effect other properties of the waxes in manners that are beneficial as will be discussed herein.

Some enzymatic transesterification methods enzymes can be used to generate candles with useful properties. For example, cocoa butter consists primarily (about 70-80% by weight) of saturated-oleic-saturated (SatOSat) triglycerides. It is this triglyceride composition which is thought to provide the unique characteristics by which cocoa butter obtains its smooth appearing β' structure. These SOS triglycerides include 1,3-dipalmitoyl-2-monooleine (POP), 1(3)-palmitoyl-3(1)-stearoyl-2-monooleine (POS) and 1,3-distearoyl-2-monooleine (SOS). Thus, oleic acid-rich glycerides with an oleic ester group in the middle position can be incubated with palmitic and stearic acid in the presence of a 1,3-specific lipase to produce POP, POS and SOS. These reactions may be useful to aid in the development of candles with a more uniform appearance.

The described methods and techniques are applicable to making waxes from polyol esters such as polyol fatty acid partial esters and triglycerol fatty acid esters. Waxes from these materials can be suitably used to form candles. For esters of fatty acids, the fatty acids can include any number of fatty acids including palmitic acid, stearic acid, oleic acid, hydroxylated fatty acid esters such as ricinoleic acid. Other fatty acids which may which may be present in esterified form as part of a polyol ester include oleic acid, linoleic acid, arachidonic acid, erucic acid, caproic acid, caprylic acid, capric acid, lauric acid, myristic acid, eicosapentaenoic acid (EPA), docosahexaenoic acid (DHA), 5-eicosenoic acid.

One sign that a polyol ester has been transesterified is that when the polyol ester is further subjected to transesterification conditions, the additional resulting changes are either small (if the polyol ester had already been completely transesterified) or less than would be ordinarily expected (if the polyol ester had been only partially transesterified). This can be judged by applying the same or similar transesterification technique to the polyol ester based wax. For instance, if methoxide was used to completely randomize the polyol esters of a polyol ester based wax, application of methoxide or a randomizing enzyme to the polyol ester based portion of the wax would generally result in a polyol ester based portion that is not substantially different from the initial wax. Alternatively, if a 1,3 selective enzyme was used to transesterify a fatty acid based triglycerol, application of a 1,3 selective enzyme to the fatty acid triglycerol portion would not result in a fatty acid based triglycerol component that was substantially different than the starting fatty acid triglycerol. One way to measure this is to measure the properties of the polyol ester based wax that tend to change when transesterified (e.g. melting point, ester composition, melting curve, SFC values, etc.). For instance, a polyol ester's melting point would likely exhibit little or no change if the polyol ester were further transesterified.

Transesterification Methods

In general, transesterification can be performed by adding polyol esters in the presence of a suitable catalyst and heating the mixture. Non-limiting examples of catalysts that can be used to carry out interesterification include base catalysts (e.g. sodium methoxide), acid catalysts including inorganic acids such as sulfuric acid and acidified clays, organic acids such as methane sulfonic acid, benzenesulfonic acid, and toluenesulfonic acid, and acidic resins such as Amberlyst 15.

Metals such as sodium and magnesium, and metal hydrides may also be useful catalysts. Progress of the reaction can be monitored using standard techniques such as high performance liquid chromatography (HPLC), infrared spectrometry, thin layer chromatography (TLC), Raman spectroscopy, or UV absorption. Upon completion of the reaction, sodium methoxide catalyst can be neutralized, for example, by addition of water, aqueous ammonium chloride, or aqueous phosphoric acid. Acid catalysts can be neutralized by a base such as a sodium bicarbonate solution. Deactivated catalyst and soaps (fatty acid salts) can be removed by a water wash, followed by centrifugation. The oil can be dried by addition of anhydrous magnesium sulfate or sodium sulfate. Remaining water can be removed by heating to about 60° C. or higher under vacuum. Methyl esters can be removed by distillation.

Enzymatic methods of transesterification tend to be more specific with respect to modifying acyl groups. Enzymatic methods of transesterification tend to be used with natural fats and oils such as mono-, di-, and tri-esters of glycerol with fatty acids. The enzymes capable of affecting this transesterification in glycerides are generally known as lipases.

If a lipase is used for transesterification, it can be obtained from a cultured eukaryotic or prokaryotic cell line. The lipase can be unspecific or specific with respect to its substrate. Preferably, the lipase is a 1,3-selective lipase, which catalyzes transesterification of the terminal esters in the 1 and 3 positions of a glyceride, or a non-selective, nonspecific lipase.

The present method can include batch slurry type reactions, in which the slurry of lipases and substrates are mixed vigorously to ensure a good contact between them. The transesterification reaction may be carried out in a fixed bed reactor with immobilized lipases.

Resinous immobilized lipase can be mixed with initial or purified starting material to form a slurry which is packed into a suitable column. Initial substrate is prepared from one or more acyl group suppliers and/or polyol esters. The temperature of the substrate is regulated so that it can continuously flow though the column for contact with the lipase and be transesterified. If solid glycerides or fatty acids are used, the solid substrates are heated to a fluid state. The substrate can be caused to flow through the column(s) under the force of gravity, by using a peristaltic or piston pump, under the influence of a suction or vacuum pump, or using a centrifugal pump. The transesterified polyol esters produced are collected and the desired portions are separated from the mixture of reaction products by methods well known in the art. This continuous method involves a reduced likelihood of permitting exposure of the materials to air during reaction. Alternatively, reaction tanks for batch slurry type production can also be used. Preferably, these reaction tanks are also sealed from air so as to prevent exposure to oxygen, moisture, or other ambient oxidizing species.

Enzymatic activity tends to be affected by factors such as temperature, light and moisture content. Light can be kept out by using various light blocking or filtering means known in the art. Moisture content, which includes ambient atmospheric moisture, is controlled by operating the process as a closed system. The closed system can be under a positive nitrogenous pressure to expel moisture. Alternatively, a bed of nitrogen gas can be placed on top of the substrate, purification bed or column, or packed lipase column. Other inert gasses such as helium or argon can also be used. These techniques have the added benefit of keeping atmospheric oxidative species (including oxygen) away from the substrate, product or enzyme.

Enzymes

There are many microorganisms from which lipases useful in forming lipid-based waxes can be obtained. U.S. Pat. No. 5,219,733 lists examples of such microorganisms including those of the genus *Achromobacter* such as *A. iofurgus* and *A. lipolyticum*, the genus *Chromobacterium* such as *C. viscosum* var. *paralipolyticum*; the genus *Corynebacterium* such as *C. acnes*; the genus *Staphylococcus* such as *S. aureus*; the genus *Aspergillus* such as *A. niger* and *A. oryzae*; the genus *Candida* such as *C. cylindracea, C. antarctica* b, *C. rosa* and *C. rugosa*; the genus *Humicora* such as *H. lanuginosa*; the genus *Penicillium* such as *P. caseicolum, P. crustosum, P. cyclopium* and *P. roqueforti*; the genus *Torulopsis* such as *T. ernobii*; the genus *Mucor* such as *M. miehei, M. japonicus* and *M. javanicus*; the genus *Bacillus* such as *B. subtilis*; the genus *Thermomyces* such as *T. ibadanensis* and *T. lanuginosa* (see Zhang, H. et al. J.A.O.C.S. 78: 57-64 (2001)); the genus *Rhizopus* such as *R. delemar, R. japonicus, R. arrhizus* and *R. neveus*; the genus *Pseudomonas* such as *P. aeruginosa, P. fragi, P. cepacia, P. mephitica* var. *lipolytica* and *P. fluorescens*; the genus *Alcaligenes*; the genus *Rhizomucor* such as *R. miehei*; the genus *Humicolo* such as *H. rosa*; and the genus *Geotrichum* such as *G. candidum*. Several lipases obtained from these organisms are commercially available as purified enzymes.

Lipases obtained from the organisms above tend to be immobilized for the present method using suitable carriers by a usual method known to persons of ordinary skill in the art. Examples of some potential methods of preparation include the entrapping method, inorganic carrier covalent bond method, organic carrier covalent bond method, and the adsorption method. The present methods also contemplate using crude enzyme preparations or cells of microorganisms capable of overexpressing lipase, a culture of such cells, a substrate enzyme solution obtained by treating the culture, or a composition containing the enzyme.

Useful carriers are preferably microporous and have a hydrophobic porous surface. Usually, the pores have an average radius of about 10 Å to about 1,000 Å, and a porosity from about 20 to about 80% by volume, more preferably, from about 40 to about 60% by volume. The pores give the carrier an increased enzyme bonding area per particle of the carrier. Examples of preferred inorganic carriers include porous glass, porous ceramics, celite, porous metallic particles such as titanium oxide, stainless steel or alumina, porous silica gel, molecular sieve, active carbon, clay, kaolinite, perlite, glass fibers, diatomaceous earth, bentonite, hydroxyapatite, calcium phosphate gel, and alkylamine derivatives of inorganic carriers. Examples of preferred organic carriers include microporous Teflon, aliphatic olefinic polymer (e.g., polyethylene, polypropylene, a homo- or copolymer of styrene or a blend thereof or a pretreated inorganic support) nylon, polyamides, polycarbonates, nitrocellulose and acetylcellulose. Other suitable organic carriers include hydrophillic polysaccharides such as agarose gel with an alkyl, phenyl, trityl or other similar hydrophobic group to provide a hydrophobic porous surface (e.g., "Octyl-Sepharose CL-4B", "Phenyl-Sepharose CL-4B", both products of Pharmacia Fine Chemicals). Microporous adsorbing resins include those made of styrene or alkylamine polymer, chelate resin, ion exchange resin such a "DOWEX MWA-1" (weakly basic anion exchange resin manufactured by the Dow Chemical Co., having a tertiary amine as the exchange group, composed basically of polystyrene chains cross linked with divinylbenzene, 150 .ANG. in average pore radius and 20-50 mesh in particle size), and hydrophilic cellulose resin such as one prepared by masking the hydrophilic group of a cellulosic carrier, e.g., "Cellulofine GC700-m" (product of Chisso Corporation, 45-105 μm in particle size).

Tri(X)-TAG

Randomization of ester contents tends to reduce the number of polyesters with multiple acid chains of the same type to a statistical amount. With natural oils such as fatty acid based tri-esters of glycerol and/or their partially hydrogenated counterparts, the concentration of tri(X)-TAG esters (triglycerol esters where each of the three side chains is a given fatty acid-X) tend to be present in amounts greater than would be statistically predicted. This is even more true when these triglycerol esters have been at least partially hydrogenated (which is typical when trying to achieve sufficient properties for candle applications). These interesterified esters tend to have tri(X)-TAG concentrations much closer to a statistical distribution. For instance, triglycerol molecules having three stearic acid side chains (SSS-TAG) tend to be more common than expected in partially hydrogenated soybean oil derivatives.

The tri(X)-TAG amount can potentially affect the properties of a triglycerol based wax. For instance, large amounts of SSS-TAG can tend to increase the melting point, and can lead to sharper melting curves. The tri(X)-TAG composition for a given triglycerol ester based wax that has been randomly interesterified can be defined by the cube of the fractional concentration (expressed as a percentage) of the acid plus or minus an error factor (which represents that interesterification, in reality, will come close to giving but will not always give the exact statistical distribution). This can be expressed as $[\text{tri(X)-TAG}]=[X]^3 \pm E$, where [tri(X)-TAG] is the fractional concentration of tri(X)-TAG, [X] is the fractional concentration of X, and E is the error factor. E can be chosen as a definite number, or as a percentage of [X] or $[X]^3$. As an example, if [X] were 50 wt. %, [tri(X)-TAG] would be 12.5 wt. %±E wt. %. This can also be written as $(X^3/10^4)\pm E$ wt. %, where X is the integer value of the [X] by weight. Thus, if [X] were 50 wt. %, this would be $(50^3/10^4)\pm E$ wt. % or 12.5±E wt. %.

E is suitably selected as at least about 3 wt. %, and more preferably about 5 wt. %.

A preferable value of E where E is a percentage of [X] is $0.1[X]^3$, more preferable the value of E is $0.115[X]^3$, and even more preferably the value of E is $0.05[X]^3$. When restricted to high [X] triglycerol waxes, the value of E is preferably about $0.115[X]^3$ or $0.28[X]^3$ when [X] is at least 40 wt. %.

Some fatty acids that could be suitably be used for X include, but are not limited to, palmitic acid (PPP-TAG), stearic acid (SSS-TAG), and oleic acid (OOO-TAG). Tri(X)-TAG values are best measured when value of the concentration of X is at least a minimum amount. The concentration of X is generally not less than 20% by weight. The concentration of X is typically not less than 30%, and preferably not less than 40%. Tri(X)-TAG values tend to give more significant results when the concentration of X is not less than 50% by weight.

X may be suitably chosen as the fatty acid which is present in the highest percent concentration in the triglycerol ester portion of a wax, written as tri(HC)-TAG. Preferably, all tri(X)-TAGs meeting certain conditions meet these concentration requirements. For instance, all tri(X)-TAGs where [X] is at least about 20% or at least about 40% by weight meet the above [tri(X)-TAG] criteria.

The tri(X)-TAG values of a triglycerol ester portion of the wax can be measured. If an interesterified wax is subjected again to randomizing interesterification, the tri(X)-TAG concentrations will tend not to change very much. Thus, the tri(X)-TAG ratio of change, [tri(X)-$TAG_{before}$]/[tri(X)-$TAG_{after}$], will be about 1, where [tri(X)-$TAG_{before}$] is the percent concentration of tri(X)-TAG before the triglycerol ester based wax has been subjected to randomizing interesterification and [tri(X)-$TAG_{after}$] is the ratio of tri(X)-TAG after the triglycerol ester based wax has been subjected to randomizing interesterification. While some change is always possible in a given process, a ratio close to 1 tends to indicate that the triglycerol ester had been formed by an interesterification process. The tri(X)-TAG change ratio, t(X)-CR, can be used to characterize a given triglycerol ester based portion of a wax. t(X)-CR is generally at least 1±0.3, and more typically equal to 1±about 0.15. t(X)-CR is suitably equal to 1±0.05.

Since the amount of SSS-TAG can effect the melting properties of a triglycerol ester based wax, since stearic acid tends to be a common component of many organic triglycerol esters, and since SSS-TAG tends to be located separately from the other triglycerol ester components when analyzed using reversed-phase liquid chromotography (RP-LC), [SSS-TAG] changes are particularly well suited for determining t(X)-CR.

SFC-10:40

One common effect of interesterification of triglycerol ester based waxes is that the wax tends to take on a more uniform melting pattern. A uniform melting range tends to bring advantages such as wider melt pools and even melting of the wax. The advantages are particularly useful when making low melting point waxes for use in container candles because larger diameter candles can be burned out to the edge with smaller wicks than used before. The even melting of the wax allows for a gradual melting of the wax from the center to the edge of the candle.

One sign of this more uniform melt range is that the SFC-40 tends to decrease (less solid material at 40° C.) and SFC-10 tends to increase (more solid material at 10° C.). This is particularly true for waxes that have higher amounts of esters having unsaturated fatty acids and which have lower melting points (generally considered waxes more suitable for use in container candles). This uniformity of melting can be measured as the ratio of the SFC-10 of the triglycerol based portion of a wax compared to the SFC-40 of that portion. This ratio is expressed as SFC-10:40. Thus, an SFC-10:40 ratio of 2:1 means that twice as much material is solid at 10° C. than at 40° C.

For container candles, a resulting wax preferably has an SFC-10:40 of at least about 1.9, more preferably of at least about 2, even more preferably of at least about 2.15, and most preferably of at least about 2.5. This would generally apply to triglycerol ester based wax portions with melting points less than about 135° F. and more typically with triglycerol ester based wax portions having melting points less than about 130° F.

The transition to a more uniform melting range can also be characterized by the change in SFC-10:40 which can be written ΔSFC-10:40. Change in SFC-10:40 ratio is measured by subtracting the SFC-10:40 of the triglycerol based wax portion before random interesterification from the SFC-10:40 of the triglycerol based wax portion after interesterification. If a triglycerol wax which has been randomly interesterified is subjected to random interesterification, then the wax's ΔSFC-10:40 would be expected to be low. The ΔSFC-10:40 of a triglycerol ester portion of a wax would preferably be less than 0.5, more preferably be less than about 0.3, even more preferably be less than about 0.15, and most preferably be less than about 0.05.

Crystal Structures

The crystalline structure of a wax can affect its appearance and other qualities. β' structure tends to give a smooth even appearance to the wax, and tends to allow for a more even distribution when melted and cooled. For a candle, a β' structure tends to give a desirable appearance and texture to the wax. Depending on its composition, a triglycerol ester portion of a wax preferably can maintain a β' structure without the use of additives. For waxes that are suitable for use as candles, this can be determined by heating the triglycerol ester portion of the wax to its melting point, maintaining the triglycerol ester portion of the wax at its melting point for 20 minutes, allowing the triglycerol ester portion of the wax to cool at room temperature, and determining the resulting crystal structure of the triglycerol ester portion of the wax. The crystal structure of the resulting triglycerol ester portion of the wax can be determined using standard diffraction techniques (e.g., x-ray diffraction techniques), using methods known to those of skill inn the art. One example of a method for determining crystal structure can be found in van Malssen, Peschar, and Schenk "Real-Time X-Ray Powder Diffraction Investigations on Cocoa Butter", JAOCS 73, 1209-1215 (1996). The wax would preferably have substantially β' crystal structure (at least about 50 wt. %), and would more preferably have substantially complete β' structure (at least about 90 wt. %).

Slump Test

One measure of a wax's suitability for use in a candle is the slump test. The slump test involves placing a wax on an angled platform in an oven. Although the test may be run on a free standing candle (e.g., a pillar candle), the test is typically run with a candle in a container (e.g., either a poured container candle or a votive candle that has been placed in a holder). The oven is set at 110° F., and the wax is set on the angled platform. The wax is then left for an hour at 110° F. The temperature of the oven is increased by 1° F. every hour until the wax has been at 120° F. for an hour. If desired, the temperature can be raised beyond this point in a similar manner. The 'slump temperature' is that temperature at which the wax loses its form and/or begins to slide.

A wax for use in forming a candle desirably have a slump temperature of at least 115° F., preferably would have a slump temperature of 118° F., and more preferably would have a slump temperature of at least about 120° F. This is generally more of a problem for low melting point candle waxes (below 135° F.) such as waxes typically considered to be useful as container candle waxes.

Melting Curve

Post-interesterified candle waxes tend to have broader melt curves. These broader melt curves would typically allow for better candle properties, such as wider melt pools and even melting of the wax. In a pillar candle this broader melt curve usually allows the melt pool to reach the edge of the candle without becoming so soft that a hole develops and the wax runs down the side of the candle.

For every 5° C. range near the melting point of the polyol ester based portion of a wax, the difference between the smallest heat flow uptake value and the greatest heat flow uptake value would preferably be less than about 5 mW, more preferably less than about 3 mW, and even more preferably no more than 2 mW. For waxes to be used as candle waxes, the melt curve would preferably be measured for waxes which have undergone standard candle conditions. For waxes that are suitable for use as candles, this can be determined by heating the polyol ester portion of the wax to its melting point, maintaining the polyol ester portion of the wax at its melting point for 20 minutes, allowing the polyol ester portion of the wax to cool at room temperature, and determining the resulting melting curve of the polyol ester portion of the wax. The resulting melting curve of the polyol ester portion of the wax can be determined as in the process shown and described in Example 1 where the candle is allowed to cool at ambient room temperatures (65 to 75° C.) after the first up-heat.

Mineral Wax Mixtures

A composition may also be formed by combining a lipid based wax with a mineral wax. Some examples of mineral waxes include mineral waxes such as montan wax, peat wax, and petroleum waxes (petrolatum, paraffin wax, ozokerite and ceresin waxes).

Petroleum wax tends to be one of the more widely used waxes for current candles. The petroleum wax can be a by-product of the petroleum refining process and may be obtained commercially from suppliers such as Witco. The quality and quantity of the wax obtained from the refining process is dependent upon the source of the crude oil and the extent of the refining. The petroleum wax component of the wax composition includes, for example, a paraffin wax, including medium paraffin wax, microcrystalline paraffin wax or a combination thereof. However, petroleum wax obtained from crude oil refined to other degrees may also be used.

Although the exact chemical compositions of these waxes are not known as the nature of these by-products vary from one distillation process to the next, these waxes tend to be composed of various types of hydrocarbons. For example, medium paraffin wax is generally composed primarily of straight chain hydrocarbons having carbon chain lengths ranging from about 20 to about 40, with the remainder typically comprising isoalkanes and cycloalkanes. The melting point of medium paraffin wax is typically about 50° C. to about 65° C. Microcrystalline paraffin wax is generally composed of branched and cyclic hydrocarbons having carbon chain lengths of about 30 to about 100 and the melting point of the wax is typically about 75° C. to about 85° C. Further descriptions of the petroleum wax that may be used may be found in Kirk-Othmer, Encyclopedia of Chemical Technology, 3rd Edition, Volume 24, pages 473-76, which is hereby incorporated by reference.

The wax portions of suitable compositions typically have mineral wax portions which are less than 50 wt. % of the wax portion of the composition, with polyol ester compositions making up at least half of the wax portion. The polyol ester portions can include transesterified polyol ester portions and/or untransesterified polyol ester portions. The polyol ester portions are preferably based on triglycerol and also preferably have fatty acid portions. Other suitable compositions have up to about 25 wt. % and up to about 17 wt. % mineral wax. Other suitable compositions have less than about 5 wt. % but more than 0 wt. % mineral wax. These compositions preferably have less than about 3 wt. % mineral wax, and more preferably, less than about 1 wt. % mineral wax. If a mineral wax is used, it is typically a petroleum wax, such as paraffin wax.

Other Waxes

Solid natural waxes and synthetic waxes may be used to form the wax composition. For instance, many creatures (such as insects and animals) and plants form waxy substances that are generally solid at room temperature. Some example of the various types creature waxes are beeswax, lanolin, shellac wax, chinese insect wax, and spermaceti. Some of the examples of the various types of plant waxes are carnauba, candelila, japan wax, ouricury wax, rice-bran wax, jojoba wax, castor wax, bayberry wax, sugar cane wax, and maize wax. Additionally, synthetic waxes may be used. For instance, waxes such as polyethylene wax, Fischer-Tropsch wax, chlorinated naphthalene wax, chemically modified wax, substituted amide wax, alpha olefins and polymerized alpha olefin wax may be used.

Kits

The candle wax may be packaged as part of a candle-making kit, e.g., in the form of beads or flakes of wax, which includes also typically would include instructions with the candle wax. The candle-making kit typically would also include material which can be used to form a wick.

Additives

A wide variety of coloring and scenting agents, well known in the art of candle making, are available for use with waxy materials. Typically, one or more dyes or pigments is employed provide the desired hue to the color agent, and one or more perfumes, fragrances, essences or other aromatic oils is used provide the desired odor to the scenting agent. The coloring and scenting agents generally also include liquid carriers which vary depending upon the type of color- or scent-imparting ingredient employed. The use of liquid organic carriers with coloring and scenting agents is preferred because such carriers are compatible with petroleum-based waxes and related organic materials. As a result, such coloring and scenting agents tend to be readily absorbed into waxy materials. It is especially advantageous if a coloring and/or scenting agent is introduced into the waxy material when it is in the form of prilled granules.

The colorant is an optional ingredient and is commonly made up of one or more pigments and dyes. Colorants are typically added in a quantity of about 0.001-2 wt. % of the waxy base composition. If a pigment is employed, it is typically an organic toner in the form of a fine powder suspended in a liquid medium, such as a mineral oil. It may be advantageous to use a pigment that is in the form of fine particles suspended in a vegetable oil, e.g., an natural oil derived from an oilseed source such as soybean or corn oil. The pigment is typically a finely ground, organic toner so that the wick of a candle formed eventually from pigment-covered wax particles does not clog as the wax is burned. Pigments, even in finely ground toner forms, are generally in colloidal suspension in a carrier.

If a dye constituent is utilized, it may be dissolved in an organic solvent. A variety of pigments and dyes suitable for candle making are listed in U.S. Pat. No. 4,614,625, the disclosure of which is herein incorporated by reference. The preferred carriers for use with organic dyes are organic solvents, such as relatively low molecular weight, aromatic hydrocarbon solvents; e.g. toluene and xylene. The dyes ordinarily form true solutions with their carriers. Since dyes tend to ionize in solution, they are more readily absorbed into the prilled wax granules, whereas pigment-based coloring agents tend to remain closer to the surface of the wax.

Candles often are designed to appeal to the olfactory as well as the visual sense. This type of candle usually incorporates a fragrance oil in the waxy body material. As the waxy material is melted in a lighted candle, there is a release of the fragrance oil from the liquefied wax pool. The scenting agent may be an air freshener, an insect repellent or more serve more than one of such functions.

The air freshener ingredient commonly is a liquid fragrance comprising one or more volatile organic compounds which are available from perfumery suppliers such IFF, Firmenich Inc., Takasago Inc., Belmay, Noville Inc., Quest Co., and Givaudan-Roure Corp. Most conventional fragrance materials are volatile essential oils. The fragrance can be a synthetically formed material, or a naturally derived oil such as oil of Bergamot, Bitter Orange, Lemon, Mandarin, Caraway, Cedar Leaf, Clove Leaf, Cedar Wood, Geranium, Lavender, Orange, Origanum, Petitgrain, White Cedar, Patchouli, Lavandin, Neroli, Rose and the like.

A wide variety of chemicals are known for perfumery such as aldehydes, ketones, esters, alcohols, terpenes, and the like. A fragrance can be relatively simple in composition, or can be a complex mixture of natural and synthetic chemical components. A typical scented oil can comprise woody/earthy bases containing exotic constituents such as sandalwood oil, civet, patchouli oil, and the like. A scented oil can have a light floral fragrance, such as rose extract or violet extract. Scented oil also can be formulated to provide desirable fruity odors, such as lime, lemon or orange.

Synthetic types of fragrance compositions either alone or in combination with natural oils such as described in U.S. Pat. Nos. 4,314,915; 4,411,829; and 4,434,306; incorporated herein by reference. Other artificial liquid fragrances include geraniol, geranyl acetate, eugenol, isoeugenol, linalool, linalyl acetate, phenethyl alcohol, methyl ethyl ketone, methylionone, isobornyl acetate, and the like. The scenting agent can also be a liquid formulation containing an insect repellent such as citronellal, or a therapeutic agent such as eucalyptus or menthol. Once the coloring and scenting agents have been formulated, the desired quantities are combined with waxy material which will be used to form the body of the candle. For example, the coloring and/or scenting agents can be added to the waxy materials in the form of prilled wax granules. When both coloring and scenting agents are employed, it is generally preferable to combine the agents together and then add the resulting mixture to the wax. It is also possible, however, to add the agents separately to the waxy material. Having added the agent or agents to the wax, the granules are coated by agitating the wax particles and the coloring and/or scenting agents together. The agitating step commonly consists of tumbling and/or rubbing the particles and agent(s) together. Preferably, the agent or agents are distributed substantially uniformly among the particles of wax, although it is entirely possible, if desired, to have a more random pattern of distribution. The coating step may be accomplished by hand, or with the aid of mechanical tumblers and agitators when relatively large quantities of prilled wax are being colored and/or scented.

Certain additives may be included in the present wax compositions to decrease the tendency of colorants, fragrance components and/or other components of the wax to migrate to an outer surface of a candle. Such additives are referred to herein as "migration inhibitors." The wax may include 0.1 to 5.0 wt. % of a migration inhibitor. One type of compounds which can act as migration inhibitors are polymerized alpha olefins, more particularly polymerization products formed alpha olefins having at least 10 carbon atoms and, more commonly from one or more alpha olefins having 10 to about 25 carbon atoms. One suitable example of such as polymer is an alpha olefin polymer sold under the tradename Vybar® 103 polymer (mp 168° F. (circa 76° C.); available from Baker-Petrolite, Sugarland, Tex.). The inclusion of sorbitan triesters, such as sorbitan tristearate and/or sorbitan tripalmitate and related sorbitan triesters formed from mixtures of fully hydrogenated fatty acids, in the present wax compositions may also decrease the propensity of colorants, fragrance components and/or other components of the wax to migrate to the candle surface. The inclusion of either of these types of migration inhibitors can also enhance the flexibility of the base wax material and decrease its chances of cracking during the cooling processes that occurs in candle formation and after extinguishing the flame of a burning candle. For example, it may be advantageous to add up to about 5.0 wt. % and, more commonly, about 0.1-2.0 wt. % of a migration inhibitor, such as an alpha olefin polymer, to the present wax materials Exemplary Properties of Waxes These exemplary waxes have a polyol ester component. The polyol ester component can be a complete ester (fully esterified), or can be an incomplete ester (having potential ester bonding sites of the polyol not occupied by acyl groups).

The polyol components of the waxes are preferably formed by transesterification of a precursor mixture. The precursor mixture may include polyol esters, free fatty acids, polyols, other esters, and/or other components. Some polyol esters which are particularly well suited include polyol esters of fatty acids. Some typical polyol esters include monoglyceride, diglyceride, and triglyceride. Linked glyceride esters may also be used. Glycerin and other glycerol related molecules may be used as part of the polyol mixture.

The precursor mixture could use natural, refined, and/or hydrogenated oils/fats, such as plant oils, as part of the precursor mixture. Typical plant oils/fats include Palm oil, Soybean oil, Coconut oil, Cocoa butter, Corn oil, etc. For instance, soybean oil may be used in its natural state, can be fractionated to provide soy stearine, and/or may be fully or partially hydrogenated.

The precursor mixture is preferably fully transesterified, but may be transesterified to other degrees while remaining within the scope of the exemplary embodiments. Transesterification may include using a chemical or enzyme to randomize the distribution of acyl groups. Transesterification could also include using a selective enzyme such as a 1,3 selective enzyme.

These waxes may have other components as well. For instance, a wax may have a petroleum based wax component such as a paraffin component. The wax may also have a solid natural wax component; examples of such waxes including insect wax and plant wax. The wax may also contain non-waxy components such as free fatty acids, additives, etc. The additives may be used to add color or scent, give the wax insect repellency, improve a wax's compression moldability, inhibit migration of components, and/or perform any number of other useful functions and/or give the wax any number of useful properties. The wax composition would preferably include at least about 51 wt. % of the polyol ester component. More preferably, the wax composition would include at least about 70 wt. % of the polyol ester component.

These waxes preferably have a melting point of at least about 48° C. and no more than about 70° C., but may have lower or higher melting points if desired. The waxes also preferably have Iodine Values (IV) of at least about 15 and no more than about 70, and more preferably of at least about 20. The SFC-40 for the waxes is generally at least about 15, but is preferably at least about 20, and more preferably at least about 30.

Waxes according to these exemplary embodiments preferably include any number of characteristics. For instance, a glycerol based portion of the wax preferably maintains a generally β' crystal structure when subjected to normal candle heating and cooling conditions.

Additionally, the wax or polyol wax component would preferably include no more than about 5 to 15 wt. % 16:0 fatty acids in its fatty acid profile. The wax would also preferably contain no more than 10 wt. % fatty acids having hydroxyl groups in its fatty acid profile. Further, the wax would preferably contain no more than 25 wt. % fatty acids having less than 16 carbon atoms or more than 18 carbon atoms in its fatty acid profile.

The wax can preferably pass a slump test, preferably passing it at least 120° F. The wax also preferably has an SFC-40 of at least 16. Waxes according to these embodiments also preferably do not have large spikes in their up-heat melting curves (which can be measured by calorimetry).

It may be advantageous to minimize the amount of free fatty acid(s) in a polyol fatty acid ester-based wax. Since carboxylic acids are commonly somewhat corrosive, the presence of fatty acid(s) in a the polyol fatty acid ester-based wax can increase its irritancy to skin. The present the polyol ester-based wax generally has free fatty acid content ("FFA") of no more than about 1.0 wt. % and, preferably no more than about 0.5 wt. %.

Waxes having TAG components preferably have tri(X)-TAG concentrations which are roughly equal to the cube of the concentration of the X acyl group in the acid profile. X is preferably chosen as an acyl group having a relatively high concentration in the acid profile and/or is selected to be an acyl group that is readily identifiable in the acid profile.

Also, preferably, waxes having TAG components preferably have a 1,2:1,3-SS ratio that is at least about 1.5, and more preferably, at least about 1.8. Also, the 1,2:1,3-SS ratio is typically no more than 4, and preferably no more than about 2.5.

A wax or wax component would preferably have properties that were resistant to change when further transesterified. For instance, physical properties such as melting point, SFC-40, SFC-10:40, crystal structure, tri(X)-TAG amounts, TAG profile, and others would preferably not change very much if the wax or wax component were subjected to further transesterification.

Waxes suitable for use as pillar candles generally have a melting point of at least about 55° C. and generally no more than about 70° C., preferably at least about 56° C. and no more than about 60° C. or 65° C. These waxes typically have an IV of at least about 15 or 20 and an IV of no more than about 50, and preferably no more than 45. These waxes preferably have an SF-40 of at least about 30, and more preferably of at least about 40. The wax may be in a particulate form, and the wax particles may be used to form the pillar candle by compression molding. A pillar candle may be over-dipped, or go through some other processes to attempt to give the candle an even appearance.

Waxes suitable for use in making votive candles have melting points generally in the range of about 50° C. to about 60° C., and preferably have melting points of at least about 52° C. and no more than about 58° C. These waxes preferably have an IV of about 35-65. Some votive waxes may be required to pass a slump test. These waxes would preferably be able to pass a slump test at 120° F., but may also be acceptable if they pass at temperatures as low as about 115° F. or 117° F. These waxes preferably have an SFC-40 of at least about 25.

Waxes suitable for use as containers preferably have a melting point of about 48° C. to about 58° C. More preferably the melting point is at least about 50° C. and no more than about 55° C. Also, these waxes preferably have an IV of at least about 45, and generally no more than 70. Further, these waxes typically have an SFC-10:40 of at least 1.5, and generally have an SFC-10:40 of at least 1.8. Preferably, these waxes have an SFC-10:40 of at least about 2.0, and more preferably, at least about 2.5. These waxes preferably have an SFC-40 of at least 18, and more preferably of at least 20. Occasionally, it may be desirable to have a wax suitable for use in a container candle that has an SFC-40 of no less than about 25. These waxes, like waxes suitable for use as Votive candle waxes, would preferably be able to pass a slump test at 120° F., but may also be acceptable if they pass at temperatures as low as about 115° F. or 117° F.

There are likely some waxes which may be acceptable for use as both votive and pillar waxes. Also, there are likely some waxes which may be acceptable for use as both votive and container waxes. While generally less common, there may be some waxes that are suitable for use as both pillar and container waxes as well.

Candles formed from the waxes generally include a wick in addition to the wax. The wick can be made of any number of materials, but are preferably a natural wick such as a braided cotton wick.

Formation of Candles

Candles can be produced from the polyol ester based material using a number of different methods. In one common process, the polyol ester based wax is heated to a molten state. If other additives such as colorants and/or fragrance oils are to be included in the candle formulation, these may be added to the molten wax or mixed with polyol ester based wax prior to heating. The molten wax is then solidified around a wick. For example, the molten wax can be poured into a mold which includes a wick disposed therein. The molten wax is then cooled to solidify the wax in the shape of the mold. Depending on the type of candle being produced, the candle may be unmolded or used as a candle while still in the mold. Where the candle is designed to be used in unmolded form, it may also be coated with an outer layer of higher melting point material.

Alternatively, the polyol ester based material can be formed into a desired shape, e.g., by pouring molten polyol ester based wax into a mold and removing the shaped material from the mold after it has solidified. A wick may be inserted into the shaped waxy material using techniques known to those skilled in the art, e.g., using a wicking machine such as a Kurschner wicking machine.

Polyol ester based waxes can also be formed into candles using compression molding techniques. This process often involves forming the wax into a particulate form and then introducing the particulate wax into a compression mold.

The candle wax may be fashioned into a variety of particulate forms, commonly ranging in size from powdered or ground wax particles approximately one-tenth of a millimeter in length or diameter to chips, flakes or other pieces of wax approximately two centimeters in length or diameter. Where designed for use in compression molding of candles, the waxy particles are generally spherical, prilled granules having an average mean diameter no greater than one (1) millimeter.

Prilled waxy particles may be formed conventionally, by first melting a triacylglycerol-based material, in a vat or similar vessel and then spraying the molten waxy material through a nozzle into a cooling chamber. The finely dispersed liquid solidifies as it falls through the relatively cooler air in the chamber and forms the prilled granules that, to the naked eye, appear to be spheroids about the size of grains of sand. Once formed, the prilled triacylglycerol-based material can be deposited in a container and, optionally, combined with the coloring agent and/or scenting agent.

Particulates, including prilled waxy particles, can be formed into candles using compression techniques. The particulates can be introduced into a mold using a gravity flow tank. The mold is typically a bronze or teflon mold. A physical press then applies between 1000 and 2000 pounds of pressure at the ambient room temperature (generally 65 to 85 F). The pressure can be applied from the top or the bottom. The formed candle can then be pushed out of the mold. A candle formed by this method may not tend to have even appearing sides. A candle may experience some heat (below the melting point of the candle) when run through the extruder, which heat will tend to glaze over the side and remove some of the uneven appearance. If desired, a candle formed by this method may be over-dipped in hot liquid wax to give the outer surface of the candle a smoother appearance.

Equipment and procedures for wax powder compression are described in publications such as "Powder Compression Of Candles" by M. Kheidr (International Group Inc., 1990), incorporated by reference. Compression-molding can be conducted under conditions comprising a mold pressure between about 1000-4000 psi, a compression time between about 1-20 seconds, and a prilled wax temperature between about 15° C. to about 25° C.

The particle size distribution specification of a prilled wax composition may be important for achieving a superior combination of properties in the final candle product.

The specified particle size distribution permits the prilled wax composition to have a powder density between about 0.55-0.65 grams per centimeter, and subsequently allows the compression-molded candle product to have a density between about 0.8-0.9 gram per cubic centimeter.

Additionally, the particle size distribution specification of a prilled wax composition contributes other important property improvements to the final candle product. A high degree of particle fusion is effected by the compression-molding procedure, and the final candle product is characterized by desirable hardness and strength properties, and by a high gloss or satin candle surface finish.

The present waxes can also incorporate between about 0.1-5 weight percent of a wax fusion enhancing type of additive in the prilled wax composition which is being subjected to a compression molding procedure. Suitable wax-fusion enhancer additives include benzyl benzoate, dimethyl phthalate, dimethyl adipate, isobornyl acetate, cellusolve acetate, glucose pentaacetate, pentaerythritol tetraacetate, trimethyl-s-trioxane and N-methyl pyrrolidone.

The prill composition additive may also have a beneficial effect on the combustion properties of a candle product which is compression molded.

When waxes are placed in molds to form candles, the waxes preferably have good mold release. To have 'good mold release', the wax preferably contracts enough to leave $1/16^{th}$ of an inch between the formed candle and the mold. Good mold release, as a property of a candle wax, is defined by the amount of contraction in the molded wax at a given area (which can be defined by width and length, by diameter, etc). A candle would preferably have good mold release for candles having a diameter of about 1.5 to about 3.5 inches and candles having diameters of about 4 inches to about 7 inches. The area by which mold release is defined is based on the particular application.

The basic techniques that can be used to form candles, can also be used to form other wax-based structures.

Bleaching and Deodorizing

The polyol ester based wax may also be bleached and deodorized. Bleaching can be done using diatomaceous earth which is acid activated and added under vacuum. This tends to remove soaps from the wax. Also, the polyol ester based wax can be deodorized by removing the free fatty acids. This can be done by distilling the free fatty acids at 450° F. to 500° F. The polyol based ester may also be subject to other processing and/or purifying steps.

The following examples are presented to illustrate the present invention and to assist one of ordinary skill in making and using the same. The examples are not intended in any way to otherwise limit the scope of the invention.

Example 1

Interesterification was accomplished by mixing a polyol ester precursor mixture with about 0.1 wt. % sodium methoxide under a vacuum (≦10 mm) atmosphere. The resulting mixture was heated to about 90° C. to 100° C. for thirty to 60 minutes. The reaction was quenched using 80% aq. $H_3PO_4$. The resulting product was heated and water was removed via vacuum. Table 1 shows a number of polyol compositions ("precursor mixtures") that were interesterified under these conditions. Tables 2 and 3 show some physical properties (melting point and solid fat content) of these mixtures before and after, respectively, being subjected to the interesterification reaction.

TABLE 1

| Percentages of Each Precursor Component By Weight | | | | | | | | |
|---|---|---|---|---|---|---|---|---|
| Sample # | Soy RB | Soy Stearine | Soy Hardfat | Palm Hardfat | Dimodan | H-SS | C-RB | Iodine Value |
| 1 | 25 | 0 | 75 | 0 | 0 | 0 | 0 | 34.5 |
| 2 | 0 | 55 | 45 | 0 | 0 | 0 | 0 | 51.1 |
| 3 | 30 | 0 | 70 | 0 | 0 | 0 | 0 | 40.0 |
| 4 | 0 | 60 | 40 | 0 | 0 | 0 | 0 | 55.6 |
| 5 | 50 | 0 | 50 | 0 | 0 | 0 | 0 | 66.5 |
| 6 | 0 | 0 | 50 | 0 | 0 | 0 | 50 | 5.7 |
| 7 | 45 | 0 | 55 | 0 | 0 | 0 | 0 | 60.0 |
| 8 | 0 | 50 | 50 | 0 | 0 | 0 | 0 | 46.5 |
| 9 | 0 | 55 | 43 | 0 | 2 | 0 | 0 | 50.7 |
| 10 | 0 | 40 | 60 | 0 | 0 | 0 | 0 | 37.4 |
| 11 | 0 | 25 | 75 | 0 | 0 | 0 | 0 | 23.8 |
| 12 | 40 | 0 | 0 | 60 | 0 | 0 | 0 | 53.4 |
| 13 | 0 | 0 | 0 | 0 | 0 | 100 | 0 | 40.0 |

H-SS represents the amount of hydrogenated soy stearine in the precursor mixture.

TABLE 2

| Physical Properties of Precursor Mixtures | | | |
|---|---|---|---|
| Sample | Melt | SFC 10 | SFC 40 |
| 1 | 154.4 | 77.1 | 70.8 |
| 2 | 148.9 | 75.0 | 44.0 |
| 3 | 153.0 | 75.1 | 68.5 |
| 4 | 146.5 | 72.8 | 40.0 |

TABLE 2-continued

Physical Properties of Precursor Mixtures

| Sample | Melt | SFC 10 | SFC 40 |
|---|---|---|---|
| 5 | 150.2 | 56.1 | 44.5 |
| 6 | 148.5 | 92.3 | 47.3 |
| 7 | 151.0 | 60.5 | 49.2 |
| 8 | 149.9 | 80.6 | 50.1 |
| 9 | 148.2 | 78.7 | 44.2 |
| 10 | 152.5 | 85.7 | 60.5 |
| 11 | 155.5 | 90.1 | 76.1 |
| 12 | 135.7 | 64.8 | 54.9 |
| 13 | 129.1 | 97 | 51.9 |

TABLE 3

Physical Properties of Waxes After Interesterification

| Sample | Melt | SFC 10 | SFC 40 |
|---|---|---|---|
| 1 | 147.0 | 81.1 | 53.7 |
| 2 | 127.1 | 87.9 | 34.8 |
| 3 | 145.5 | 80.8 | 48.6 |
| 4 | 122.8 | 79.0 | 23.0 |
| 5 | 125.3 | 48.7 | 16.8 |
| 6 | 118.0 | 91.4 | 16.0 |
| 7 | 128.1 | 57.6 | 23.1 |
| 8 | 129.4 | 87.7 | 40.4 |
| 9 | 125.3 | 85.5 | 32.4 |
| 10 | 133.9 | 89.0 | 55.0 |
| 11 | 139.9 | 94.6 | 74.7 |
| 12 | 139.9 | 64.6 | 25.7 |
| 13 | 125.3 | 97 | 47.2 |

For tables 2 and 3, SFC values are listed as the percent, by weight, of the composition which is solid at the given temperature. Melting point was determined by Mettlar dropping point (AOCS Cc 18-80).

Example 2

Each of Samples 2 and 13 from Example 1 were analyzed for their TAG content and DSC curves both as a precursor mixture and as an interesterified wax.

Triacylglycerols (TAGs) were separated by $C_{18}$ reversed-phase liquid chromatography (RP-LC) coupled to an evaporative light scattering detector (ELSD). A gradient binary mobile phase system consisting of acetonitrile and methylene chloride was used at 10° C. for the separation. During this run the column chiller stopped working and separations were run at room temperature (approximately 25° C.). This caused a loss of resolution for some of the compounds. The mobile phase flow rate was 0.7 mL/min. The ELSD settings were 35° C., a pressure of 3.5 bar, and nitrogen was used as the nebulizing gas. Calibration curves were log-log linear and based upon triolein (000) as the external standard. The internal standard was a C33 TAG at 10 mg. Standards and samples were diluted in methylene chloride. Soybean oil was used as a reference material. A mixture of mono- and mixed acid TAGs was used as retention time marker.

Figure 2:
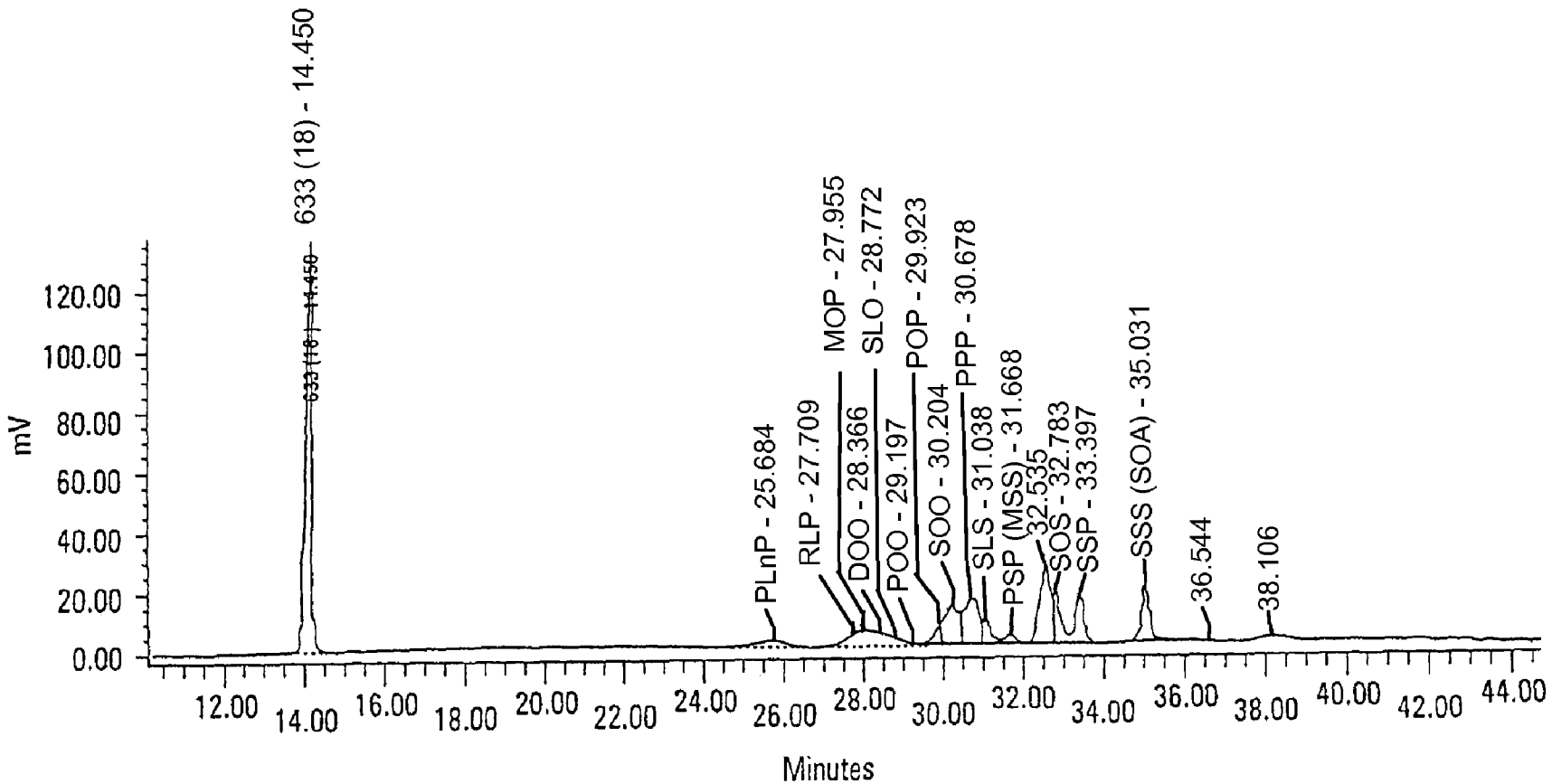
FIG. 2 shows a TAG profile of the Sample 2 Mixture (of Table 1) after to interesterification ("Sample 2 Interesterified Wax").

Referring to FIGS. 1 and 2, the triacylglycerol (TAG) profiles of Sample 2 Precursor Mixture and Sample 2 Interesterified Wax are shown in FIGS. 1 and 2 respectively. The fatty acid composition for both samples was nearly identical, however, the TAG composition profiles were different as evidenced by the chromatograms. The large SSS (tristrearin) peak in FIG. 1 should be correct since it matched retention time with a standard. It was present at 28.8% w/w. This peak decreased in Sample 2 Interesterified Wax to 7.7% in FIG. 2 (although identification is tentative Due to retention time shifting). The SSP peak appeared to be present in both samples, at 10.82% and 6.97% w/w in Sample 2 Precursor Mixture and Sample 2 Interesterified Wax, respectively (again, this peak was tentatively identified). The TAG amounts in the hump peaks were 33.4% w/w in Sample 2 Precursor Mixture and 54.4% w/w in Sample 2 Interesterified Wax. Other unidentified peaks were not included in the total. Approximately 60-70% w/w of the TAGs were accounted for.

Figure 3:
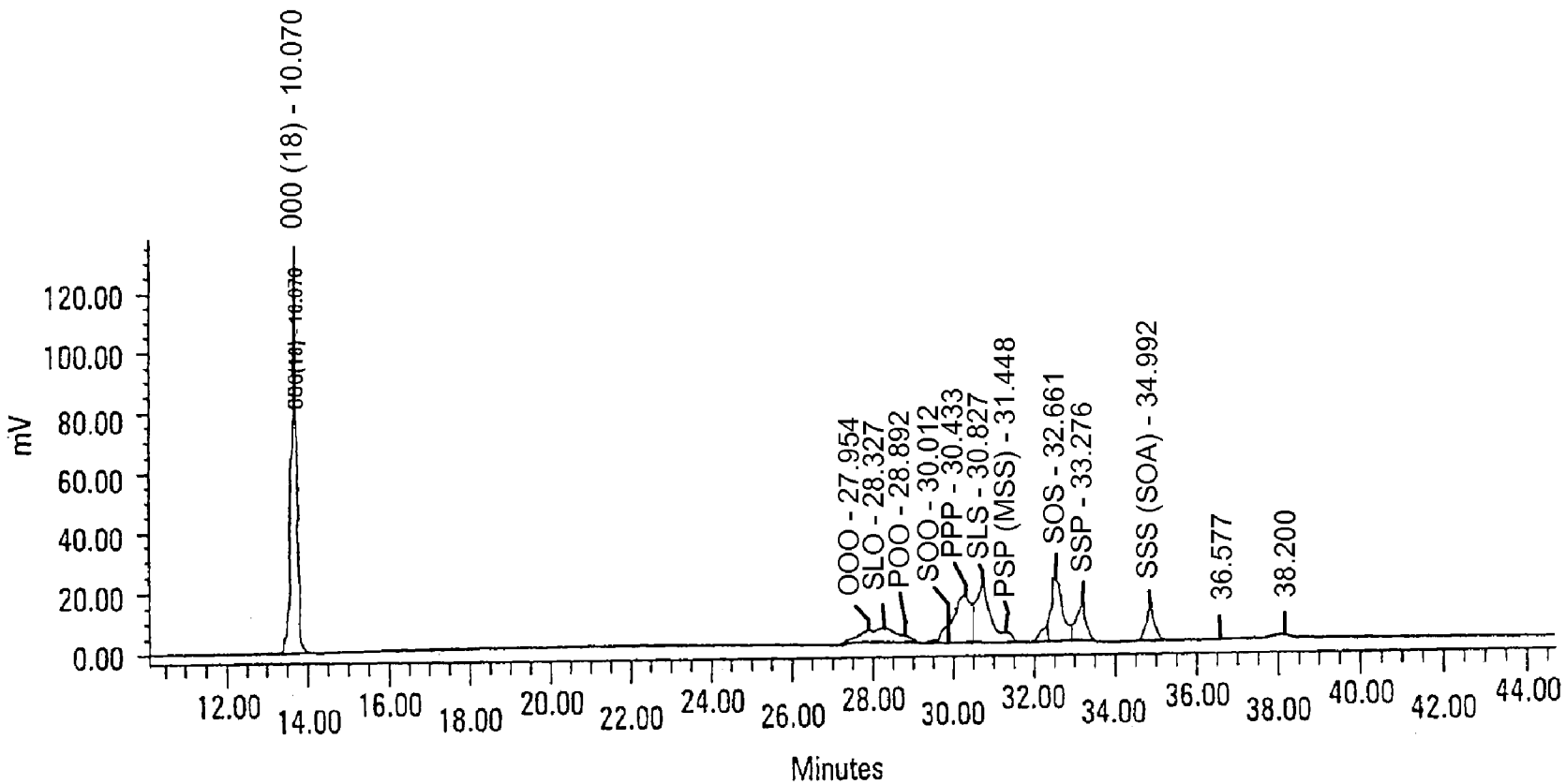
FIG. 3 shows a TAG profile of the Sample 13 Precursor Mixture (of Table 1) prior to interesterification.
Figure 4:
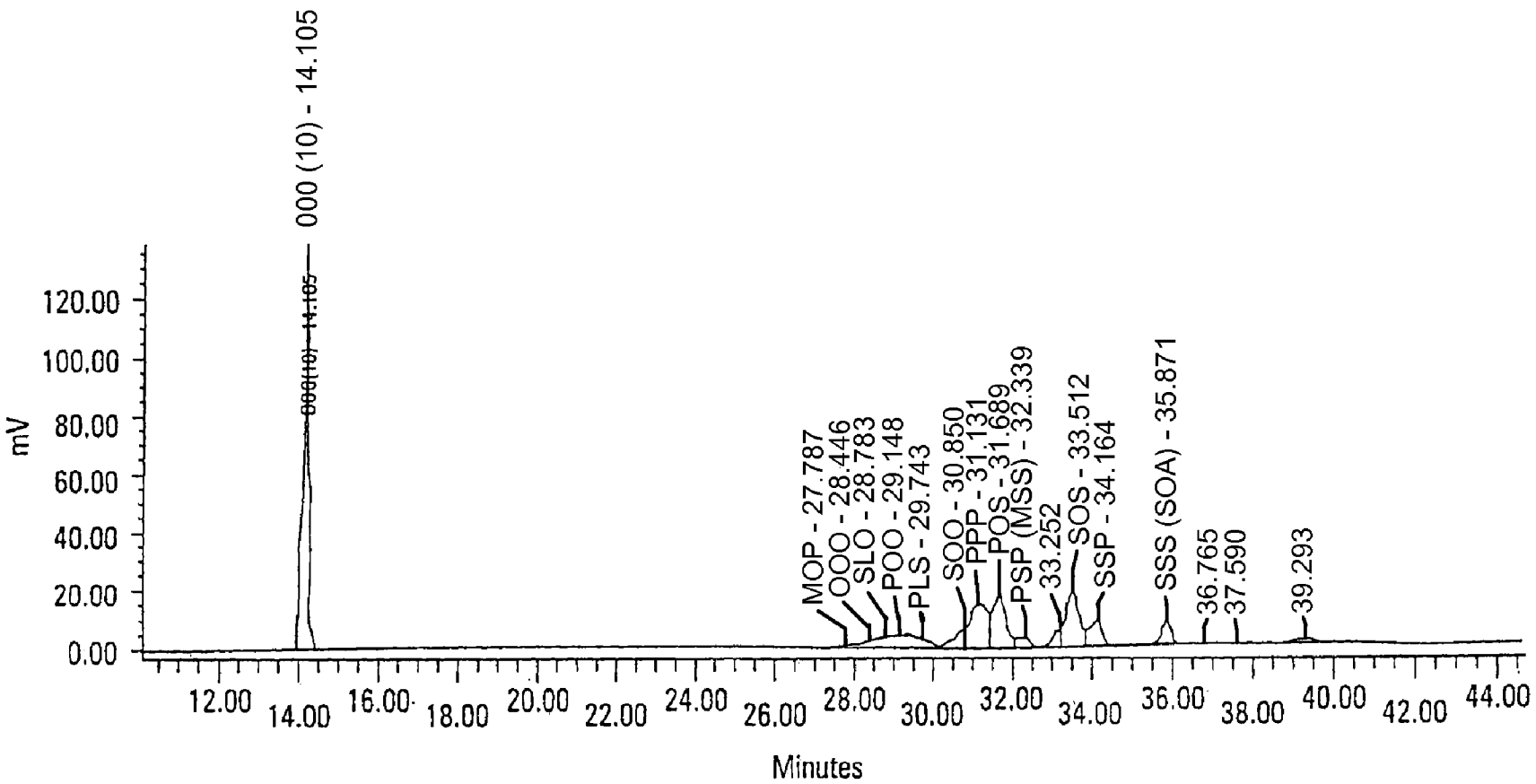
FIG. 4 shows a TAG profile of the Sample 13 Mixture (of Table 1) after to interesterification ("Sample 13 Interesterified Wax").

Referring to FIGS. 3 and 4, Sample 13 Precursor Mixture and Sample 13 Interesterified Wax TAG chromatograms are shown in FIGS. 3 and 4. The tristearin concentrations were 5.5% and 4.4% w/w for Sample 13 Precursor Mixture and Sample 13 Interesterified Wax, respectively. The SSP peak concentration was 7.1% and 6.3% w/w for Sample 13 Precursor Mixture and Sample 13 Interesterified Wax, respectively.

Example 3

Samples 2 and 13 from Example 1 were also evaluated using differential scanning calorimetry (DSC). The thermal profile performed on the samples included an initial cool from room temperature to −30° C. From −30° C., the sample was heated to 90° C. cooled back to −30° C. and heated back to 90° C. The first up-heat erases all thermal history. The cool down is controlled fast cooling at 40° C./minute. The second up-heat allows the direct comparison of sample melting characteristics of flash-chilled waxes because of their identical thermal histories.

Figure 5:
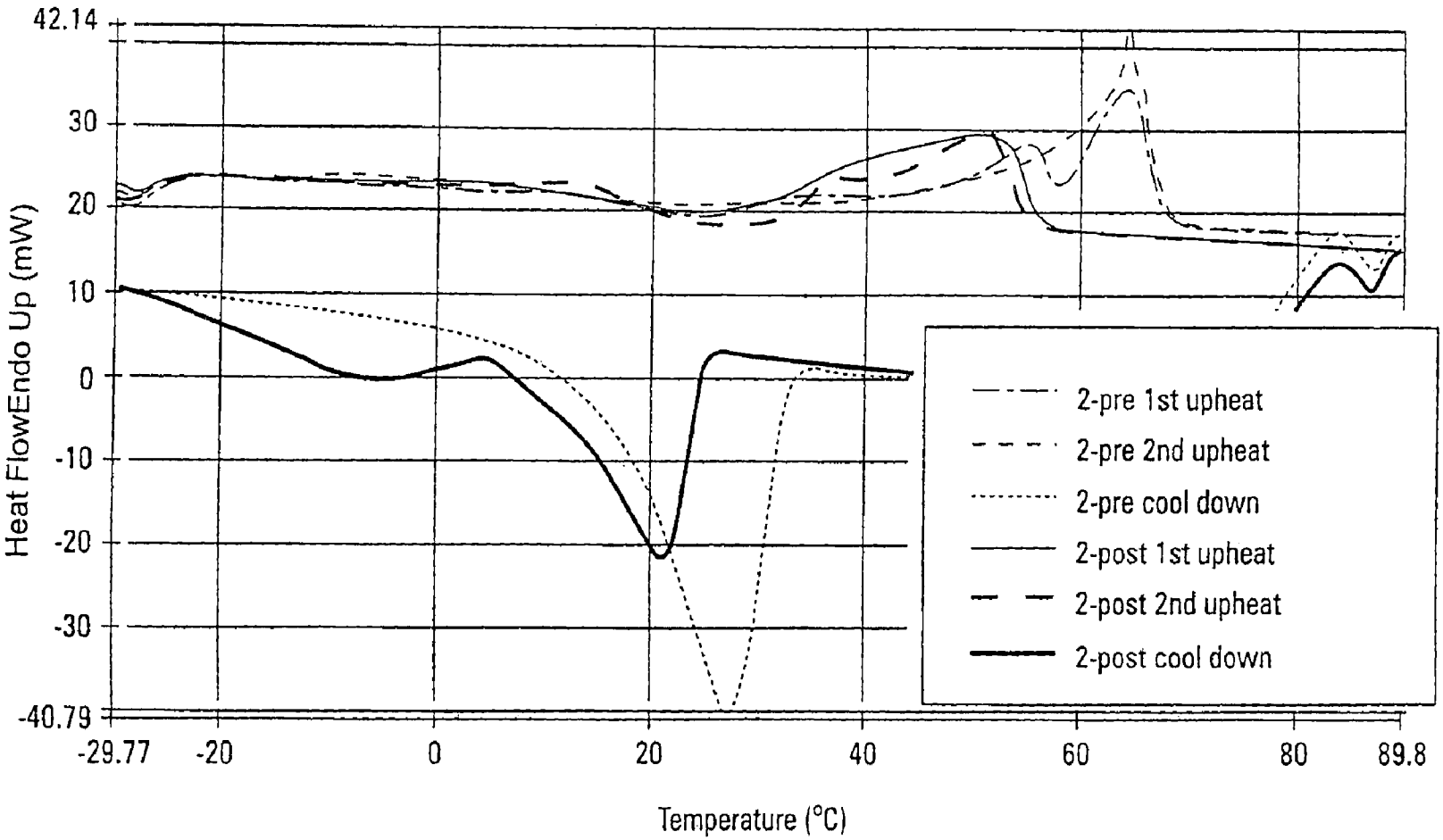
FIG. 5 shows a DSC scan of up-heats of the Sample 2 Precursor Mixture (2-pre) and the Sample 2 Interesterified Wax (2-post) as described in Example 3.

Referring to FIG. 5, the first up-heat of Sample 2 Precursor Mixture (2-pre) and Sample 2 Interesterified Wax (2-post) shows a broadening of the melting curve near the melting point when compared to the melting curve of the precursor mixture (2-pre). The high melting fraction and the low melting fraction appeared to have migrated towards each other when the precursor mixture was interesterified and the "sharp spike" observed in the first upheat melting curve of the Sample 2 Precursor Mixture is essentially absent in the first upheat melting curve of Sample 2 Interesterified Wax. The samples were rapidly cooled, and the cool down and $2^{nd}$ upheat of the waxes were also measured.

Figure 6:
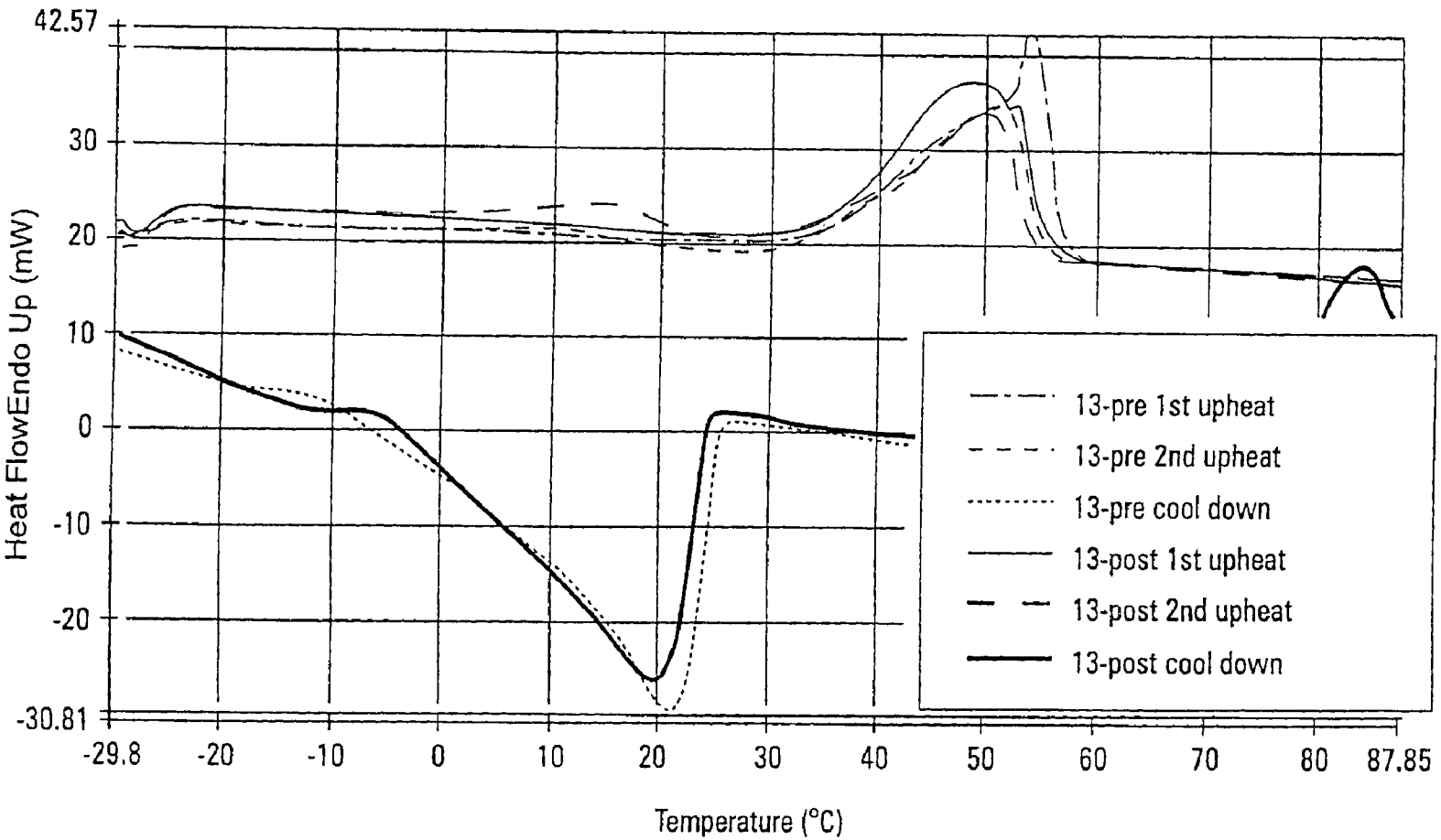
FIG. 6 shows a DSC scan of the first up-heat of the Sample 13 Precursor Mixture (13-pre) and the Sample 13 Interesterified Wax (13-post) as described in Example 3.

Referring to FIG. 6, the first up-heat of Sample 13 Interesterified Wax (13-post) shows a broadening of the melting curve near the melting point. The "sharp spike" observed in the first upheat melting curve of the Sample 13 Precursor Mixture (13-pre) is essentially absent in the first upheat scan of the Sample 13 Interesterified Wax. The samples were rapidly cooled, and the cool down and $2^{nd}$ upheat of the waxes were also measured.

Example 4

A wax with a composition similar to that of Sample 2 was formed into a container candle and subjected to a burn test. Fragrance was added to the wax in the amount of 6 wt. %, along with 0.5 g of dye. An HTP 1212 cotton wick from Wicks Unlimited was placed in a 16 oz 4" diameter glass container. The wax was melted and the molten wax was poured in the container.

During the burn test the flame reached a maximum flame height of 30 mm. The melt pool melted all the way out to the edges of the container and achieved a depth of ¼". The melt pool reached a maximum temperature of 160° F. during the duration of the burn. The wax had a disappearance of 4.6 g/hr during the burn test. There was no sooting noted during the burn duration. Upon cooling the wax came back to a smooth surface with little or no marring. The sides of the resolidified candle were smooth with little to no whiting left where the melt pool had been. The time for the wax to resolidify was 20 minutes.

Illustrative Embodiments

A number of illustrative embodiments of the present lipid-based waxes and candles produced therefrom are discussed herein. The embodiments described are intended to provide illustrative examples of the present waxes and candles and are not intended to limit the scope of the invention.

In one embodiment, the wax composition includes of a petroleum wax, free fatty acid, and/or renewable resource wax (such as plant wax or insect wax). These waxes are preferably only present in the composition up to about 49% by weight. The petroleum wax may include a medium paraffin wax, a microcrystalline paraffin wax and/or a petroleum wax obtained from crude oil refined to other degrees. In another embodiment, the wax composition includes up to about 25% by weight of the alternate waxes. In still another embodiment, the wax composition includes no more than about 10% by weight of the alternate waxes.

One embodiment is directed to a lipid-based wax composition having a melting point of about 48° C. to about 75° C. and including a polyol fatty acid ester component formed by a process which includes interesterifying a polyol fatty acid ester precursor. The polyol fatty acid ester component can include a fully esterified polyol fatty acid ester component. The wax composition commonly includes at least about 51 wt. % of the fully esterified polyol fatty acid ester component. The fully esterified polyol fatty acid ester component can include triacylglycerol. The wax preferably has a melting point of about 53° C. to 70° C., about 50° C. to 65° C., or about 48° C. to 58° C. The wax preferably has an SFC-40 of at least about 14, and more preferably at least 16 or 20. For waxes designed to be used in container candles, it may be desirable to have an SFC-10 that is at least about twice as much as its SFC-40 (i.e., the SFC-10:40 ratio is at least about 2.0).

Another embodiment is directed to a candle made from a triacylglycerol containing wax. The wax includes a wick and a wax. The wax has a melting point of about 45° C. to about 75° C. and includes a triacylglycerol component having a fatty acid composition which includes stearic acid. The triacylglycerol component preferably has a percent concentration by weight of SSS-TAG which is equal to the cube of a fractional concentration by weight of stearic acid in the fatty acid profile+E wt. %. E can be selected to be no more than a preset amount, or no more than a percentage of the SSS-TAG concentration. E is preferably selected to be no more than about 5 or 7 wt. %, and desirably less than or equal to 3 wt. %. The wax preferably includes at least about 51 wt. % of the triacylglycerol component. Stearic acid may often makeup about 30 wt. % or more of the fatty acid composition of the triacylglycerol component. Also, the 1,2:1,3-S ratio is preferably at least 1.5; the 1,2:1,3-S ratio being the percent concentration by weight of 1,2-S-3-X-triacylglycerol divided by the percent concentration by weight of 1,3-S-2-X-triacylglycerol.

Another embodiment is directed to a candle comprising a wick and a wax. The wax preferably has a melting point of about 45° C. to about 75° C. and includes a fully interesterified polyol fatty acid ester component. The polyol fatty acid ester component is preferably a triacylglycerol component.

Another embodiment provides a lipid-based wax suitable for use as a candle wax. The lipid-based wax includes a complete polyol fatty acid ester component; and has a melting point of about 50° C. to about 60° C.; an Iodine Value of about 40 to 75; and an SFC at 10° C. that is at least about twice that of the SFC at 40° C.

Another embodiment is directed to another polyol-based wax suitable for use as a candle wax. The polyol-based wax includes a complete polyol fatty acid ester component; and has a melting point of about 45° C. to 65° C. and an SFC-40 of at least about 16. The wax preferably has an Iodine Value of about 40 to 75.

Another embodiment provides an ester-based composition which includes at least about 51 wt. % of an interesterified polyol fatty acid ester. The composition can also include a wax component such as an insect wax or other naturally occurring wax and/or a petroleum wax. The ester-based wax can also have a melting point of about 45° C. to 60° C. and/or an SFC-40 of at least about 16 or 20.

Another embodiment is directed to a candle having a wick and a wax. The wax has a melting point of about 45° C. to about 75° C. and includes a triacylglycerol component. The triacylglycerol component preferably has a percent concentration by weight of tri(HC)-TAG which is equal to the cube of the percent concentration by weight of HC in the fatty acid profile+E wt. %. HC is selected to be the fatty acid which is present in the greatest amount in the fatty acid composition of the triacylglycerol component, and tri(HC)-TAG is a triacylglycerol having three HC fatty acid acyl groups.

Another embodiment is directed to a method for forming a wax. The method includes creating a precursor mixture which includes at least (a) triacylglycerol and (b) glycerin and/or other polyol (e.g. propylene glycol and/or sorbitan). The method further includes interesterifying the precursor mixture.

Another embodiment is directed to a polyol-based wax suitable for use as a candle wax. The polyol-based wax includes a complete polyol fatty acid ester component. The wax preferably has a melting point of about 130° F. to 155° F. (about 54° C. to 68° C.), and an SFI-40 of at least about 40. The wax also preferably has an Iodine Value of about 20 to 45.

Another embodiment provides a lipid-based wax suitable for use as a candle wax. The lipid-based wax includes at least about 50 wt. % of a fully interesterified polyol fatty acid ester component. The lipid-based wax preferably has a melting point of about 130° F. to 155° F. (about 54° C. to 68° C.) and/or an SFI-40 of at least about 40. The lipid-based wax preferably includes a polyol fatty acid partial ester, and more preferably includes at least about 10% or 20% of a polyol fatty acid partial ester. The lipid-based wax can also include a petroleum wax, an insect wax, some other naturally occurring wax, or some other type of wax such as a non- or partially-interesterified polyol fatty acid component. The lipid-based wax can also include a free fatty acid component. The fatty acid composition of the lipid-based wax preferably does not include more than about 15 wt. % palmitic acid. The fatty acid composition of the lipid-based wax also preferably includes no more than about 1.0 wt. % 18:3 fatty acid. The lipid-based wax preferably has a slump temperature of at least about 118° F. Typically, the wax has at least about 70 wt. % of the fully interesterified polyol ester component, and preferably includes at least 85 wt. %.

Another embodiment is directed to a candle having a wick and a wax. The wax preferably has a melting point of about 45° C. to about 75° C. The wax includes a triacylglycerol component formed by a process which includes interesterifying a precursor mixture. The precursor mixture can include triglycerides, fatty acid monoglycerides, fatty acid diglycerides, fatty acid alkyl esters, free fatty acids, glycerin, and/or other esters or polyols.

Another embodiment is directed to a method for forming a triglycerol based wax. The method comprises mixing glycerin with free fatty acids to form a precursor mixture. The method also includes interesterifying the precursor mixture.

Another embodiment is directed to a wax suitable for use as a candle wax. The wax includes a triacylglycerol component and has a melting point of about 48° C. to about 75° C. The triacylglycerol component preferably has a substantially β' structure when subjected to normal candle conditions. More preferably, the triacylglycerol component has a substantially complete β' structure when subjected to normal candle conditions.

Another embodiment provides a wax suitable for use as a candle wax. The wax includes a polyol ester component and has a melting point of about 48° C. to about 75° C. The properties of the wax are preferably resistant to change when subjected to interesterification. Measurement of resistance to change can be measured by a small change in melting point after interesterification (no more than about 3 or 5° C.). Alternatively, measurement of resistance to change can be measured by a small change in SFC-10 and/or SFC-40 (preferably no more than about 1 or 3 wt. %). Further still, measurement of resistance to change can be measured by a small change in SFC-10:40, relative concentrations of the polyol esters (such as [tri(X)-TAG]), crystal structure, and/or other properties of the wax.

Another embodiment is directed to a wax suitable for use as a candle wax. The wax has a polyol ester component and a melting point of about 45° C. to about 75° C. The wax may have a melting point of about 48° C. to about 58° C. More preferably the melting point is at least about 50° C. Further, the melting point is preferably no more than about 55° C. The wax may have an IV of at least about 45. The wax have further have an IV which is not greater than about 70. Further, the wax may have an SFC-10:40 of at least 1.5, and potentially an SFC-10:40 of at least 1.8. The SFC-10:40 of the wax is more preferably at least about 2.0, and more preferably, at least about 2.5. The wax preferably has an SFC-40 of at least 16, and more preferably of at least 20. The wax may be able to pass a slump test at least about 117° F., and preferably at least about 120° F. The polyol ester component preferably includes a polyol polyester component such as a triacylglycerol component. The triacylglycerol component preferably has a substantially β' structure. The polyol ester component is preferably at least 51 wt. % of the wax, and more preferably at least 85 wt. % of the wax. The wax preferably does not have a large spike in its melting curve as measured by DSC. The polyol ester component preferably does not have a large spike in its melting curve as measured by DSC. The wax may contain other components such as solid natural waxes (insect waxes, plant waxes, etc.), mineral waxes (paraffin), synthetic waxes, or other wax components. These wax components preferably comprise a smaller percentage of the wax than the polyol ester component. This wax may have additives that add color, that add scent, that inhibit migration of components, that give the wax insect repellancy, and/or other additives. The polyol ester may be formed from a precursor mixture including one or more plant oils (such as soybean oil or palm oil). The plant oils can be natural, refined, and/or hydrogenated. Transesterification preferably includes interesterifying a precursor mixture resulting in an interesterified precursor mixture. The wax can have TAG components having a 1,2:1,3-S ratio that is at least about 1.5, and preferably, at least about 1.8. The wax can have TAG components where the tri(X)-TAG concentrations is roughly equal to the cube of the concentration of the X acyl group in the acid profile. The X acyl group can be selected from stearic acid, the acid in the highest concentration in the acid profile, all acids whose concentration is at least 20 or 30 wt. % in the acid profile, or some other acid.

Another embodiment is directed to a wax suitable for use as a candle wax. The wax has a polyol ester component and a melting point of about 45° C. to about 75° C. The wax can have a melting point of about 50° C. to about 60° C., and preferably has a melting point of at least about 52° C. and no more than about 58° C. The wax preferably has an IV of about 35-65. The wax would preferably be able to pass a slump test at least about 117° F., and more preferably at least about 120° F. The wax can have an SFC-40 of at least about 20, or at least about 25. The polyol ester component preferably includes a polyol polyester component such as a triacylglycerol component. The triacylglycerol component preferably has a substantially β' structure. The polyol ester component is preferably at least 51 wt. % of the wax, and more preferably at least 80 wt. % of the wax. The wax preferably does not have a large spike in its melting curve as measured by DSC. The polyol ester component preferably does not have a large spike in its melting curve as measured by DSC. The wax may contain other components such as solid natural waxes (insect waxes, plant waxes, etc), mineral waxes (paraffin), synthetic waxes, or other wax components. These wax components preferably comprise a smaller percentage of the wax than the polyol ester component. This wax may have additives that add color, that add scent, that inhibit migration of components, that give the wax insect repellancy, and/or other additives. The polyol ester may be formed from a precursor mixture including one or more plant oils (such as soybean oil or palm oil). The plant oils can be natural, refined, and/or hydrogenated. Transesterification preferably includes interesterifying a precursor mixture resulting in an interesterified precursor mixture. The wax can have TAG components having a 1,2:1,3-S ratio that is at least about 1.5, and preferably, at least about 1.8. The wax can have TAG components where the tri(X)-TAG concentrations is roughly equal to the cube of the concentration of the X acyl group in the acid profile. The X acyl group can be selected from stearic acid, the acid in the highest concentration in the acid profile, all acids whose concentration is at least 20 or 30 wt. % in the acid profile, or some other acid.

Another embodiment is directed to a wax suitable for use as a candle wax. The wax has a polyol ester component and a melting point of about 45° C. to about 75° C. The wax may be limited to having a melting point of at least about 55° C. and no more than about 70° C. Further, the wax may have a melting point of no more than about 65° C. Further still, the wax may have a melting point of about 56° C. to about 60° C. The IV for the wax may be at least about 15. Additionally, the IV of the wax may be no more than about 50. Further, the wax may have an IV of about 20 to about 45. The wax may have an SFC-40 of at least 30. Further, the wax may have an SFC-40 of about 40. The wax may be in particulate form. The polyol ester component preferably includes a polyol polyester component such as a triacylglycerol component. The triacylglycerol component preferably has a substantially β' structure. The polyol ester component is preferably at least 51 wt. % of the wax, and more preferably at least 80 wt. % of the wax. The wax preferably does not have a large spike in its melting curve as measured by DSC. The polyol ester component preferably does not have a large spike in its melting curve as measured by DSC. The wax may contain other components such as solid natural waxes (insect waxes, plant waxes, etc.), mineral waxes (paraffin), synthetic waxes, or other wax components. These wax components preferably comprise a smaller percentage of the wax than the polyol ester component. This wax may have additives that add, color, that add scent, that improve compression moldability, that inhibit migration of components, and/or other additives. The polyol ester may be formed from a precursor mixture including one or more plant oils (such as soybean oil or palm oil). The plant oils can be natural, refined, and/or hydrogenated. Transesterification preferably includes interesterifying a precursor mixture resulting in an interesterified precursor mixture.

Another embodiment is directed to a wax suitable for use as a candle wax. The wax has a polyol ester component and a melting point of about 45° C. to about 75° C. The polyol ester component preferably includes a polyol polyester component such as a triacylglycerol component. The triacylglycerol component preferably has a substantially β' structure. The polyol ester component is preferably at least 51 wt. % of the wax, and more preferably at least 80 wt. % of the wax. The wax preferably does not have a large spike in its melting curve as measured by DSC. The polyol ester component preferably does not have a large spike in its melting curve as measured by DSC. The wax may contain other components such as solid natural waxes (insect waxes, plant waxes, etc.), mineral waxes (paraffin), synthetic waxes, or other wax components. These wax components preferably comprise a smaller percentage of the wax than the polyol ester component. This wax may have additives that add color, that add scent, that inhibit migration of components, that improve compression moldability, that give the wax insect repellancy, and/or other additives. The polyol ester may be formed from a precursor mixture including one or more plant oils (such as soybean oil or palm oil). The plant oils can be natural, refined, and/or hydrogenated. Transesterification preferably includes interesterifying a precursor mixture resulting in an interesterified precursor mixture. The wax can have TAG components having a 1,2:1,3-S ratio that is at least about 1.5, and preferably, at least about 1.8. The wax can have TAG components where the tri(X)-TAG concentrations is roughly equal to the cube of the concentration of the X acyl group in the acid profile. The X acyl group can be selected from stearic acid, the acid in the highest concentration in the acid profile, all acids whose concentration is at least 20 or 30 wt. % in the acid profile, or some other acid. The wax may be in particulate form. The wax would preferably be able to pass a slump test at least about 117° F., and more preferably at least about 120° F. The wax can have an SFC-40 of at least about 14 or 18. The properties of the polyol ester component of the wax may be configured such that the properties of the polyol ester component would not change by very much if it were subjected to transesterification. The wax may have free fatty acid concentrations and/or particulate concentrations that are no more than about 1 wt. % each. The polyol ester component would preferably include no more than about 5 to 15 wt. % 16:0 fatty acids in its acid profile. The wax would also preferably contain no more than about 10 wt. % fatty acids having hydroxyl groups in its fatty acid profile. Further, the wax would preferably contain no more than 25 wt. % fatty acids having less than 16 carbon atoms or more than 18 carbon atoms in its fatty acid profile. The wax may have an IV of about 15 to 70.

One illustrative embodiment provides a lipid-based wax composition which has having a melting point of about 48° C. to about 75° C. The lipid-based wax can include a completely esterified polyol fatty acid ester component, which formed by a process which comprises interesterifying a polyol fatty acid ester precursor. The completely esterified polyol fatty acid ester component generally accounts for at least about 51 wt. % of the wax, preferably accounts for at least about 70 wt. %.

In another embodiment, a fatty acid ester-based composition includes a petroleum wax, e.g., a microcrystalline petroleum wax, and at least about 51 wt. % of an interesterified polyol fatty acid ester. In many instances, the lipid-based wax contains at least about 75 wt. % and, more desirably, at least about 90 wt. % of the interesterified polyol fatty acid ester. The interesterified polyol fatty acid ester generally includes a substantial amount of a completely esterified polyol fatty acid ester. It is often quite desirable to employ a lipid-based wax which includes at least about 51 wt. % of a fully interesterified fatty acid triacylglycerol.

In another embodiment, a fatty acid ester-based composition includes a insect wax, e.g., beeswax, and at least about 51 wt. % of an interesterified polyol fatty acid ester. In many instances, the lipid-based wax contains at least about 75 wt. % and, more desirably, at least about 90 wt. % of the interesterified polyol fatty acid ester. The interesterified polyol fatty acid ester generally includes a substantial amount of a completely esterified polyol fatty acid ester. It is often quite desirable to employ a lipid-based wax which includes at least about 51 wt. % of a fully interesterified fatty acid triacylglycerol.

In another embodiment, a fatty acid ester-based composition includes at least about 51 wt. % of an interesterified polyol fatty acid ester and a crystal modifier such as a insect wax, e.g., beeswax. In many instances, the lipid-based wax contains at least about 75 wt. % and, more desirably, at least about 90 wt. % of the interesterified polyol fatty acid ester. The interesterified polyol fatty acid ester generally includes a substantial amount of a completely esterified polyol fatty acid ester. It is often quite desirable to employ a lipid-based wax which includes at least about 51 wt. % of a fully interesterified fatty acid triacylglycerol.

Another embodiment is directed to a candle which includes a wick and a lipid-based wax. The wax has a melting point of about 48° C. to about 75° C. and may include a fully interesterified polyol fatty acid ester component. Very often, the lipid-based wax includes a substantial amount, e.g., at least about 51 wt. % of a fully interesterified triacylglycerol component. The wax may also include a partially esterified polyol ester, such as a fatty acid monoglyceride and/or a fatty acid diglyceride.

Other embodiments may provide a candle which includes a wick and a wax. The wax can have a melting point of about 48° C. to about 70° C. and include a triacylglycerol component having a fatty acid composition which includes X wt. % stearic acid. The triacylglycerol component commonly has an SSS-TAG content which is given by $(X^3/10^4)+5$ wt. %. In certain waxes of this type, the SSS-TAG content which is given by $(X^3/10^4)+3$ wt. %. The triacylglycerol component may have a ratio of SQS-TAG content:SSQ-TAG content of at least about 1.0; wherein S represents stearic acid and Q represents a fatty acid which is not stearic acid. In certain instances, the triacylglycerol component of the wax may have a ratio of SQS-TAG content:SSQ-TAG content of no more than about 0.7.

In certain embodiments, in addition to an interesterified polyol fatty acid ester, such as an interesterified fatty acid triacylglycerol, the lipid-based wax may include a second wax component. The second wax component may selected from the group consisting of petroleum waxes, insect waxes, other plant-based waxes (e.g., bayberry wax, candidelia wax and carnuba wax) and/or free fatty acids.

Another embodiment is directed to a lipid-based wax suitable for use as a candle wax. The lipid-based wax includes a completely esterified polyol fatty acid ester component; and has a melting point of about 130° F. to 155° F.; an SFI-40 of at least about 40; and an Iodine Value of about 20 to 45. The lipid-based wax may also include a polyol fatty acid partial ester.

Yet another embodiment provides a lipid-based wax suitable for use as a candle wax, where the lipid-based wax includes at least about 51 wt. % of a fully interesterified polyol fatty acid ester component. The lipid-based wax has a melting point of about 130° F. to 155° F.; and an SFI-40 of at least about 40.

Another embodiment provides a lipid-based wax suitable for use as a candle wax, where the lipid-based wax comprises a complete polyol fatty acid ester component; and has a melting point of about 50° C. to 60° C.; an SFI-40 of at least about 20; and an Iodine-Value of about 40 to 75.

Another embodiment provides a A lipid-based wax suitable for use as a candle wax, where the lipid-based wax includes at least about 51 wt. % of an interesterified completely esterified polyol fatty acid ester component. The lipid-based wax has a melting point of about 50° C. to 60° C.; an SFI-40 of at least about 20.

Another embodiment is directed to a lipid-based wax suitable for use as a candle wax. The lipid-based wax has a melting point of about 48° C. to about 70° C. and includes at least about 51 wt. % of a triacylglycerol component having a fatty acid composition which includes X wt. % "HC fatty acid", where the HC fatty acid is the fatty acid present in highest concentration in the fatty acid composition; and the triacylglycerol component has a tri(HC)-TAG content which is given by $(X^3/10^4)+5$ wt. % and, more desirably, $(X^3/10^4)+3$ wt. %.

Another embodiment provides a lipid-based wax suitable for use as a candle wax, where the lipid-based wax includes a complete polyol fatty acid ester component; and has a melting point of about 50° C. to about 60° C.; an Iodine Value of about 40 to 75; and an SFI-10:SFI-40 ratio of at least about 2.0.

Another embodiment provides a candle comprising a wick and a lipid-based wax. The lipid-based wax has a melting point of about 48° C. to about 75° C. and includes a fully interesterified polyol fatty acid ester component, such as a fully interesterified triacylglycerol component. The lipid-based wax can include 75 wt. % or more of the fully interesterified polyol fatty acid ester component. The lipid-based wax may also include a petroleum wax, an insect wax, another plant-based wax (e.g., bayberry wax, candidelia wax and/or carnuba wax), a polyol fatty acid partial ester and/or free fatty acids.

Another embodiment provides a lipid-based wax suitable for use as a candle wax, where the lipid-based wax includes a complete polyol fatty acid ester component; and has a melting point of about 125° F. to about 140° F.; an SFI-40 of at least about 20; and an Iodine Value of about 30 to 65.

Yet another embodiment is directed to lipid-based wax suitable for use as a candle wax, where the lipid-based wax includes a completely esterified polyol fatty acid ester component. The lipid-based wax has a melting point of about 50° C. to about 60° C.; an Iodine Value of about 40 to 75; and an SFI-10:SFI-40 ratio of at least about 2.0.

Another embodiment provides a candle comprising a wick and a lipid-based wax. The lipid-based wax has a melting point of about 50° C. to about 70° C. and includes at least about 51 wt. % of a triacylglycerol component having a fatty acid composition which includes X wt. % Z:0 fatty acid; the triacylglycerol component having an tri(Z:0)-TAG content which is given by $(X^3/10^4)+5$ wt. %; wherein the Z:0 fatty acid is the saturated fatty acid present in highest concentration in the fatty acid composition. More desirably, the tri(Z:0)-TAG content is given by $(X^3/10^4)+3$ wt. %.

The invention has been described with reference to various specific and illustrative embodiments and techniques. However, it should be understood that many variations and modifications may be made while remaining within the spirit and scope of the invention.

The invention claimed is:

1. A candle comprising a wick and a lipid-based wax: wherein the lipid-based wax comprises an interesterified polyol fatty acid ester component; and the lipid-based wax has a melting point of about 55° C. to 75° C.; an SFI-40 of at least about 20; and an Iodine Value of about 15 to 65.

2. The candle of claim 1 wherein the lipid-based wax has an SFI-40 of at least about 40.

3. The candle of claim 1 wherein the lipid-based wax has a slump temperature of at least about 120° F.

4. The candle of claim 1 wherein the lipid-based wax includes at least about 51 wt. % of a fully interesterified polyol fatty acid ester component.

5. The candle of claim 4 wherein the fully interesterified polyol fatty acid ester component includes a fully interesterified triacylglycerol component.

6. The candle of claim 1 wherein the lipid-based wax has a melting point of at least about 60° C.

7. The candle of claim 1 wherein the lipid-based wax further comprises a polyol fatty acid partial ester.

8. The candle of claim 1 wherein the lipid-based wax includes a fatty acid monoglyceride ester, a fatty acid diglyceride ester or a mixture thereof.

9. The candle of claim 1 wherein the lipid-based wax further comprises a second component selected from the group consisting of petroleum waxes, insect waxes, free fatty acids and mixtures thereof.

10. A candle comprising a wick and a lipid-based wax: wherein the lipid-based wax has a melting point of about 48° C. to about 75° C. and includes at least about 51 wt. % of a polyol fatty acid ester component formed by a process which comprises interesterifying a polyol fatty acid ester precursor mixture.

11. A candle comprising a wick and a lipid-based wax: wherein the lipid-based wax has a melting point of about 48° C. to about 75° C. and includes at least about 51 wt. % of a triacylglycerol component having a fatty acid composition which includes X wt. % stearic acid; and the triacylglycerol component has a SSS-TAG content which is given by $(X^3/10^4)+/-3$ wt. ° A).

* * * * *

UNITED STATES PATENT AND TRADEMARK OFFICE

CERTIFICATE OF CORRECTION

PATENT NO. : 8,157,873 B2
APPLICATION NO. : 12/903570
DATED : April 17, 2012
INVENTOR(S) : Timothy A. Murphy et al.

It is certified that error appears in the above-identified patent and that said Letters Patent is hereby corrected as shown below:

In the Claims

In column 32, claim 11, line 54, after "$10^4$) +/-3" replace "wt. ˚A)." with --wt. %.--.

Signed and Sealed this
Twenty-sixth Day of June, 2012

David J. Kappos

David J. Kappos
*Director of the United States Patent and Trademark Office*